United States Patent [19]

Breisch

[11] 4,085,589

[45] Apr. 25, 1978

[54] GAS POWERED MOTOR AND SYSTEM

[75] Inventor: John H. Breisch, Lakewood, Ohio

[73] Assignee: Midland-Ross Corporation, Cleveland, Ohio

[21] Appl. No.: 651,548

[22] Filed: Jan. 22, 1976

Related U.S. Application Data

[60] Continuation-in-part of Ser. No. 633,425, Nov. 19, 1975, which is a division of Ser. No. 483,575, Jun. 27, 1974, Pat. No. 3,981,229, which is a continuation-in-part of Ser. No. 378,334, Jul. 11, 1973, abandoned, which is a division of Ser. No. 173,832, Aug. 23, 1971, abandoned.

[51] Int. Cl.[2] ..... F02N 9/04

[52] U.S. Cl. ..... 60/626

[58] Field of Search ..... 60/626, 627, 628, 629, 60/630, 625

[56] References Cited

U.S. PATENT DOCUMENTS

| | | | |
|---|---|---|---|
| 1,093,065 | 4/1914 | Morgan | 60/626 |
| 2,849,857 | 9/1958 | Davids | 60/627 |
| 3,664,123 | 5/1972 | Zucca et al. | 60/627 |

*Primary Examiner*—Allen M. Ostrager

*Attorney, Agent, or Firm*—Bosworth, Sessions & McCoy

[57] ABSTRACT

An economical gas powered starting system is provided for relatively small, consumer operated implements powered by two or four cycle internal combustion engines. A low cost, radial piston starter motor is coupled to a liquified gas energy cell by a metering arrangement which charges a predetermined amount of gas to the motor, just sufficient to start the engine in its operating environment. The system and motor design disclosed develops torque-speed-time characteristics insuring excellent starter reliability.

17 Claims, 38 Drawing Figures

FIG. 11
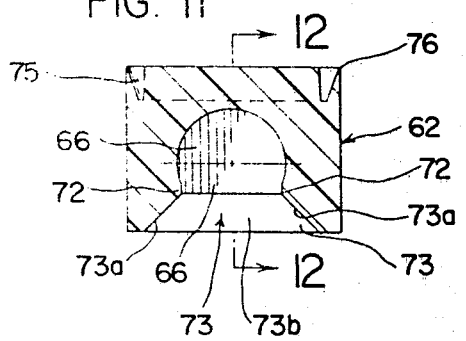
FIG. 12
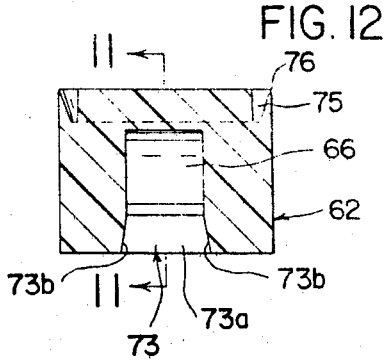
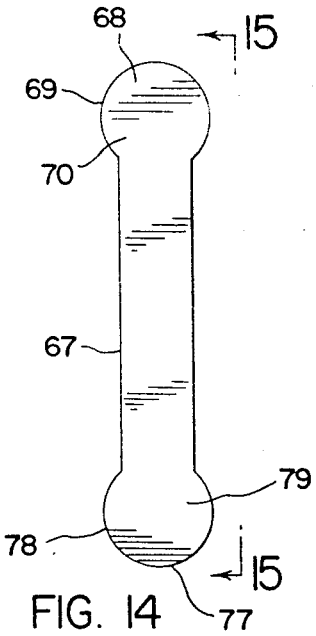
FIG. 14
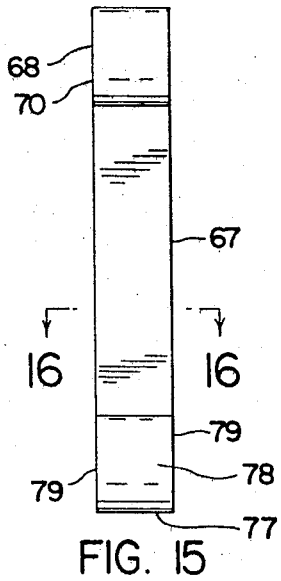
FIG. 15
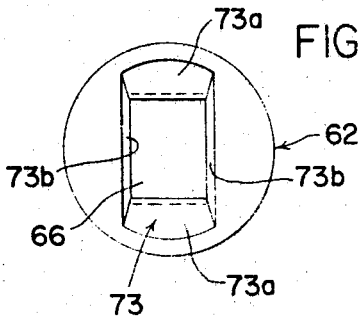
FIG. 13
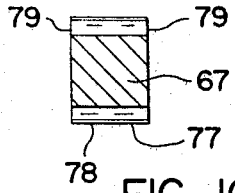
FIG. 16

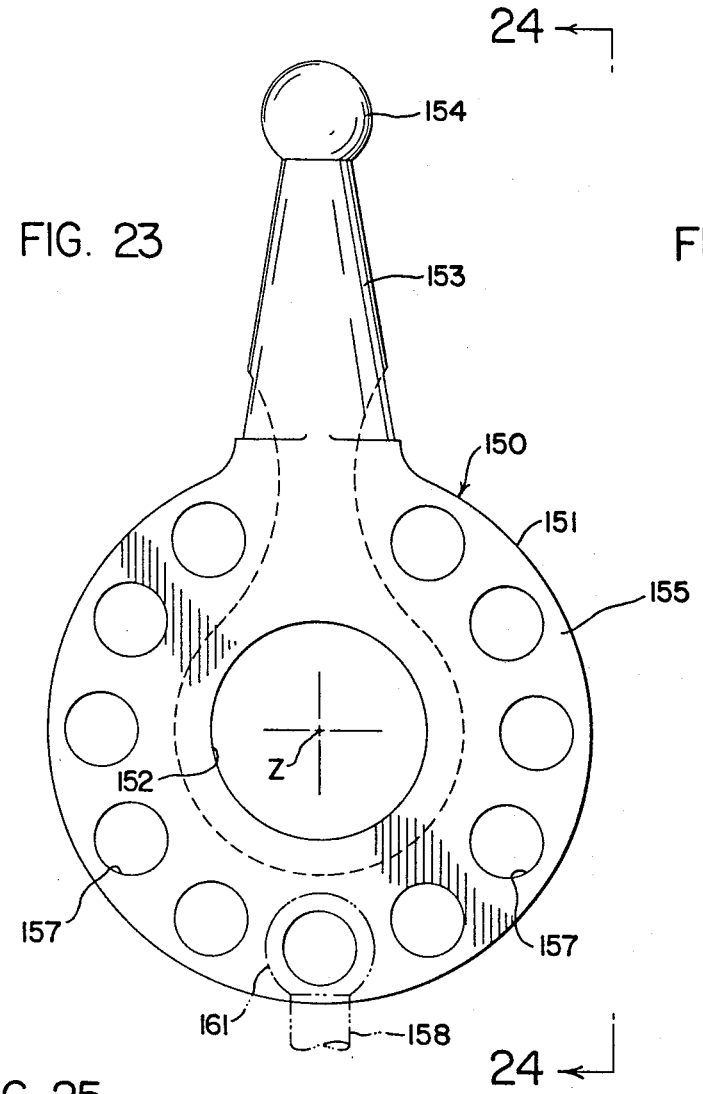
FIG. 23
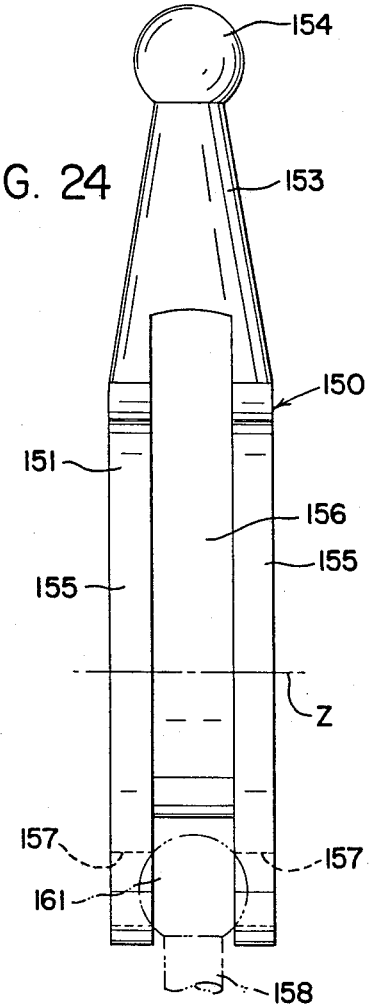
FIG. 24
FIG. 25
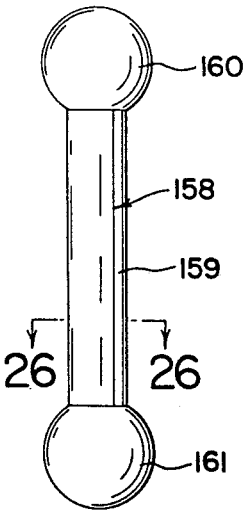
FIG. 26
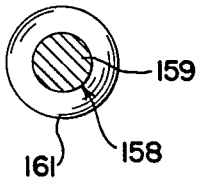
FIG. 27
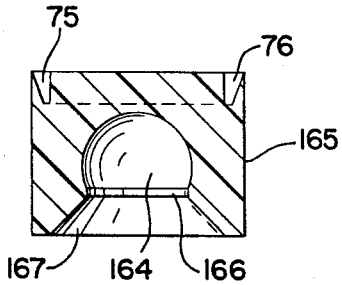
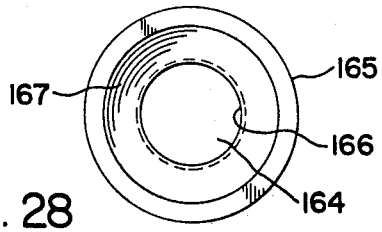
FIG. 28

GAS POWERED MOTOR AND SYSTEM

This application is a continuation-in-part of application Ser. No. 633,425, filed Nov. 19, 1975 which is a division of application Ser. No. 483,575, filed June 27, 1974 now U.S. Pat. No. 3,981,229, which is a continuation-in-part of application Ser. No. 378,334 filed July 11, 1973 now abandoned, which is a division of application Ser. No. 173,832 filed Aug. 23, 1971 now abandoned.

This invention relates to a starting motor and system and, more particularly, to a gas powered starting motor and system therefor.

The invention is particularly applicable to a gas powered motor and starting system for relatively small, consumer operated implements powered by two or four cycle internal combustion engines such as walk-behind lawn mowers, chain saws, snowblowers and the like and will be described with particular reference thereto. However, it will be appreciated by those skilled in the art that the invention has broader applications and may be used for starting internal combustion engines of larger horsepower than that disclosed, or for driving power tools such as drills and the like where a source of electrical power may not be available, or, if available, is hazardous to use.

The majority of consumer operated, portable implements driven by small two or four cycle internal combustion engines such as walk-behind lawn mowers, chain saws, etc. are supplied with manual, rope pull starting systems. Not surprisingly, safety statistics have shown that there is a definite need to replace the manual rope pull system with an automatic starting system. At present, there are only two commercially marketed starter systems which may qualify as being "automatic". Each of these systems is afflicted with problems peculiar to the lawn mower and chain saw environment which has prevented widespread use.

The first system is the known spring type starter where a spring is precompressed by a manually operated crank mechanism and then released by a switch. Present spring starter systems require substantial operator effort to fully precompress the spring and do not impart sufficient starting torque or impact to the engine for a sufficient time period to insure a satisfactory starting percentage, especially if the engine is "cold". Furthermore, since the spring must be manually precompressed, the system will not be considered "safe" especially in a chain saw environment, where the operator may be perched in a tree while attempting to wind the spring.

The second starting system is the electric start system, which has earned widescale acceptance in starting large internal combustion engines but has met with limited success in the small internal combustion engine market. An inherent deficiency in the use of an electric start system for a lawn mower and chain saw environment is believed to reside in the fact that, at present, a lightweight battery containing sufficient charge capacity to drive the electric motor has not been developed. Furthermore, assuming the development of such battery, the torque characteristics of the electric motor will require substantial gearing to be used with the motor, all of which (the battery, the motor and the gearing) will result in a prohibitive system cost.

It is therefore an object of this invention to provide an economical and reliable gas powered starting system especially adapted for use with small horsepower engines driving consumer operated implements as typified by lawn mowers, chain saws, etc. and the environments within which they operate.

This object along with other features of the subject invention is achieved by a starting system which comprises an energy cell defined as a source of liquified gas contained in a suitably shaped storage bottle, a gas powered motor and a metering valve arrangement between the motor and energy cell. The metering valve arrangement and motor operating characteristics are matched, as explained in detail hereafter, so that a predetermined amount or weight of gas is charged to the motor to insure that a satisfactory starting rate or percentage is achieved while optimizing in a conversing manner the gas used to start the engine. Importantly, since the gas used throughout the system is conserved, the energy cell is minimized in size, weight and cost. Therefore, the user need not replace the energy cell at frequent intervals and the cell cost, when replaced, is not prohibitive, thereby providing an attractive marketing package.

In accordance with another feature of the invention, the metering valve arrangement comprises a plenum chamber and a valve associated therewith, whereby the cell delivers a predetermined amount of gas to the plenum which in turn exhausts the gas therefrom to drive the motor and start the engine. The plenum is designed to automatically regulate itself to conserve gas even though the pressure of the gas in the energy cell changes in accordance with varying ambient temperatures.

Still another feature of the invention resides in employing $CO_2$ as the liquified gas and positioning the plenum closely adjacent the motor and engine while placing the energy cell upright and removed from the engine thereby counteracting any tendency of the $CO_2$ gas from liquifying in the plenum while also minimizing pressure drop in the gas as it is conveyed from the plenum to a motor.

In accordance with yet another feature of the invention, the motor employed in the system is optimized in its performance and in its energy conservation by the selection of a radial piston motor design preferably having at least eight cylinders and employing a commutator type valve having an opening or valve timing spanning between 1.5 and 2.5 cylinders. The passages through the valving into the cylinders are sized to throttle the motor to permit the motor to develop predetermined torque characteristics for a time period which lasts at least through the first compression-ignition stroke of the engine with sufficient inertia developed in the engine to carry it through at least the next compression-ignition stroke at a speed not significantly reduced from the speed of the first compression-ignition stroke. Alternatively stated, the torque developed by the motor is sufficient to insure that the engine to be started is rotated through at least three of its compression-ignition strokes with the first compression-ignition stroke occurring at an engine speed of at least 650–700 rpm.

In accordance with still another feature of the invention, the motor which is capable of developing the torque and operating speed requirements defined above is economically manufactured, for the most part, from plastic with a minimum amount of components. The components include a one piece cylinder block having a hub portion generally concentric with an axis and defining a central opening. One end of the opening is closed by an end face portion having a valve drive opening extendng therethrough. Extending radially outwardly from the hub portion is a plurality of hollow cylinder portions. In each cylinder portion is positioned a plastic piston, and a master rod member having a central bore disposed therein is inserted in the central opening of the cylinder block and connected by a connecting rod arrangement to the piston so that the master rod member rotates in a circular path about the axis of the block as the pistons move within the cylinders. At the opposite side of the hub portion of the cylinder block is a support member having a bore extending therethrough. A metal crankshaft with one end journaled in the bore of the support member and its opposite offset end extending through and journaled in the bore of the master rod member transmits the torque from the motor to a clutch arrangement on the engine. A backplate is secured to the end plate portion of the cylinder block to uniquely define a plurality of spaced radial passages, each passage leading to and being in fluid communication with a cylinder. Mounted in sealing engagement with the backplate is a simple plastic commutator valve arrangement driven by the crankshaft to close and then open adjacent passages in a circular, sequential manner.

A yet more specific feature of the invention is to provide a ring, preferably of a plastic material identical to that of the cylinder block, which is shrunken over the top of the cylinder portions thereby prestressing the cylinder and hub portions to prevent distortion and subsequent failure of the cylinder block during motor operation. Other motor features are disclosed.

These and other objects, advantages and features of the invention will become apparent from the following description of the preferred embodiments of the invention in connection with the following drawings.

FIG. 11 is a cross section, to a larger scale than that of FIG. 4, through one of the pistons of the engine of FIGS. 1 to 10 inclusive, the view being taken along line 11—11 of FIG. 12;

FIG. 12 is a cross section of the same piston, along line 12—12 of FIG. 11;

FIG. 13 is a view from the bottom of the piston as shown in FIGS. 11 and 12, showing the shape of the socket that receives the end of the connecting rod, and of the recess at the entrance to the socket;

FIG. 14 is a side elevation of one of the individual connecting rods adapted to be pivotally connected between the piston and the connecting rod mounting means;

FIG. 15 is a view of the connecting rod from line 15—15 of FIG. 14;

FIG. 16 is a section along line 16—16 of FIG. 15;

FIG. 23 is a view to a scale approximating that of FIGS. 11 to 16 inclusive, of the master connecting rod member of a different embodiment of the invention having a spherical end which is adapted to be snapped into a socket in the pistons;

FIG. 24 is a view from line 24—24 of FIG. 23;

FIG. 25 is a view to the same scale as FIGS. 11 to 16 inclusive, of a different embodiment of individual connecting rod, this one having portions of spheres at both ends, and adapted to be used with the master connecting rod of FIGS. 23 and 24 and the piston of FIGS. 27 and 28;

FIG. 26 is a section along line 26—26 of FIG. 25;

FIG. 27 is a different embodiment of the piston from that of FIGS. 7 to 12 inclusive, having a spherical socket in which an end of the connecting rod of FIGS. 23 and 24 may be held;

FIG. 28 is a bottom view of the piston of FIG. 27;

Figure 1:
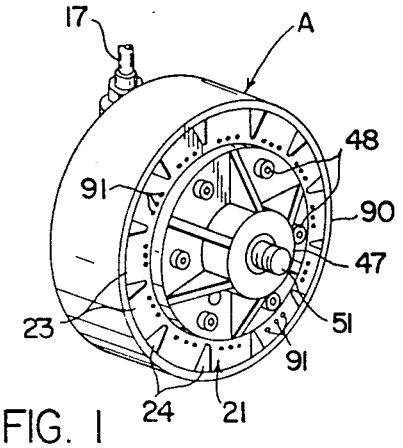
FIG. 1 is an isometric external view, to a small scale, of an engine embodying the invention.
Figure 2:
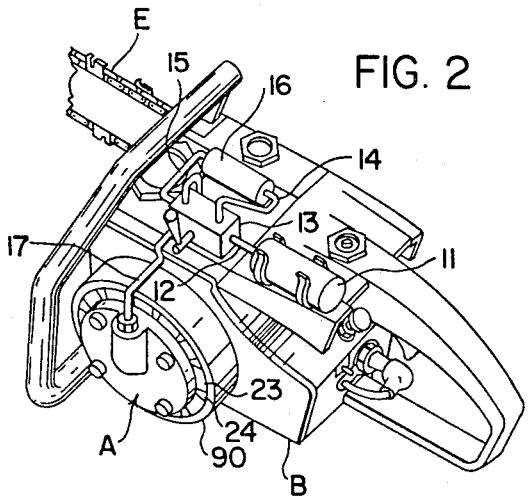
FIG. 2 is a perspective view to a smaller scale showing a chain saw of a known type having a known internal combustion engine to drive the saw, which chain saw embodies a starter motor embodying the invention for starting the internal combustion engine.
Figure 37:
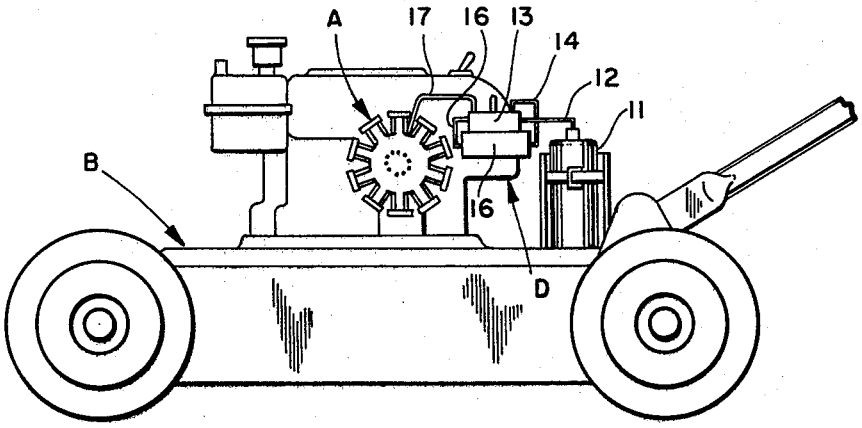
FIG. 37 is a diagrammatic view of a walk-behind powered lawn mower showing the starting system of the invention mounted thereon.

Referring now to the drawings wherein the showings are for the purpose of illustrating preferred embodiments of the invention only and not for the purpose of limiting same, there is shown in FIGS. 2 and 37 a gas powered motor A mounted to the frame of a consumer operated implement B such as a chain saw (FIG. 2) or walk-behind lawn mower (FIG. 37) adapted to rotate for starting through a one way clutch C (FIGS. 3 and 29) an internal combustion engine D that, when started, operates the implement in the conventional manner, i.e., the chain E of the saw.

MOTOR

Motor A as shown in FIGS. 3–7 comprises a unitary cylinder block 21 circular about an axis X and embodying identical radial cylinders 22 of circular cross section, preferably equidistantly and equiangularly arranged around axis X. The cylinders have axes Y that preferably lie in the same plane normal to axis X. The cylinders extend to the circular periphery of the cylinder block in cylinder portions 23, which are separated by spaces 24 for weight saving and economy of material. The cylinder block includes a plurality of generally radial inlet conduits 25, one for each cylinder, each terminating in a transverse conduit 26 opening into the outermost end of one of cylinders 22.

The inner end of each conduit 25 terminates in a port 27 in an axially extending inner circular surface 28 concentric about axis X. A radially extending surface 29 concentric about axis X and facing outwardly and away from the cylinders, joins surface 28 to define an opening 30, concentric about axis X, at the side of the cylinder block.

A rotatable, commutator-type, valve member 31 concentric about axis X has concentric axial and radial outer surfaces 32 and 33 rotatably fitting substantially gas-tight against axial and radial inner surfaces 28 and 29 of opening 30. Member 31 has a generally radial conduit 34 having an outlet port 35 shown as angularly wide enough to communicate simultaneously with pairs of ports 27 in sequence. However, port 35 may extend in an angular direction to communicate with only one, or more than two, ports 27 so as to feed gas to a desired number of cylinders at a time.

Conduit 34 opens into a central recess 36 in valve member 31, which recess fits over a hub portion 37 of a closure member 38 having an axial concentric ridge 39 that fits tightly against axial surface 28 and against a radial outer surface on the cylinder block, and is demountably held in place by bolts 40 extending through member 38 and threaded into the cylinder block. Suitable sealing means, such as O-ring 41 in annular groove 42 in hub 37 of member 38, seals rotatable valve member 31 gas-tight to the hub member. Closure member 38 has a gas inlet passage 43 one end of which opens through hub 37 into central recess 36 of valve member 31, and the other end of which is connected to tube 17 supplied with pressurized gas.

The other side of the cylinder block has another opening 44 defined by axial surface 45 concentric about axis X. This opening may be the same size as opening 30. A finished radial concentric surface 46 on the cylinder block adjoins surface 45. A supporting member 47 having axial and radial surfaces adapted to fit closely on surfaces 45 and 46 is mounted and accurately located on the cylinder block, being demountably secured by bolts 48 extending through member 47 and threaded into the cylinder block. Member 47 has an axially extending bearing opening 49 concentric about axis X.

A crankshaft 51 is rotatably supported by member 47. The crankshaft comprises a shaft portion 52 closely fitting but rotatable in opening 49 of member 47, a crank throw portion 53, and a crank pin 54 rigidly fixed to portion 53 and cylindrical and coaxial about another axis Z offset from and parallel to axis X. Crank pin 54 has a free end 55.

This free end extends into a recess 56 in the adjacent side of rotatable valve member 31. This recess is shown (FIG. 7) as elongated with its narrowest width lying on an axis W radial to and intersecting axis X and of a width which provides a close but movable fit with end 55 of the crank pin. The extra length along the axis W of recess 56 provides ease of assembly.

Figure 3:
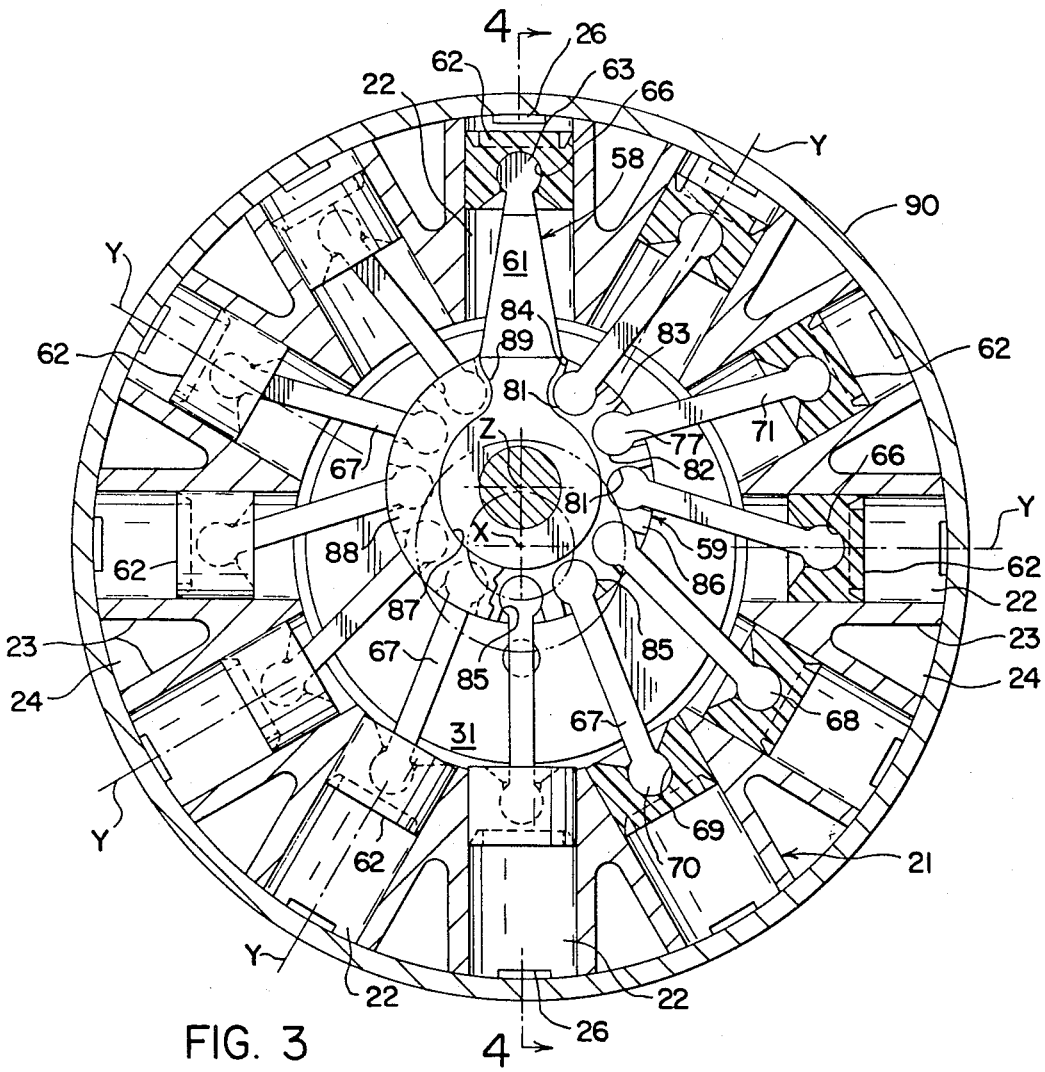
FIG. 3 is a section to a substantially larger scale than that of FIGS. 1 and 2 of a gas powered motor embodying the invention, along line 3—3 of FIG. 4.
Figure 4:
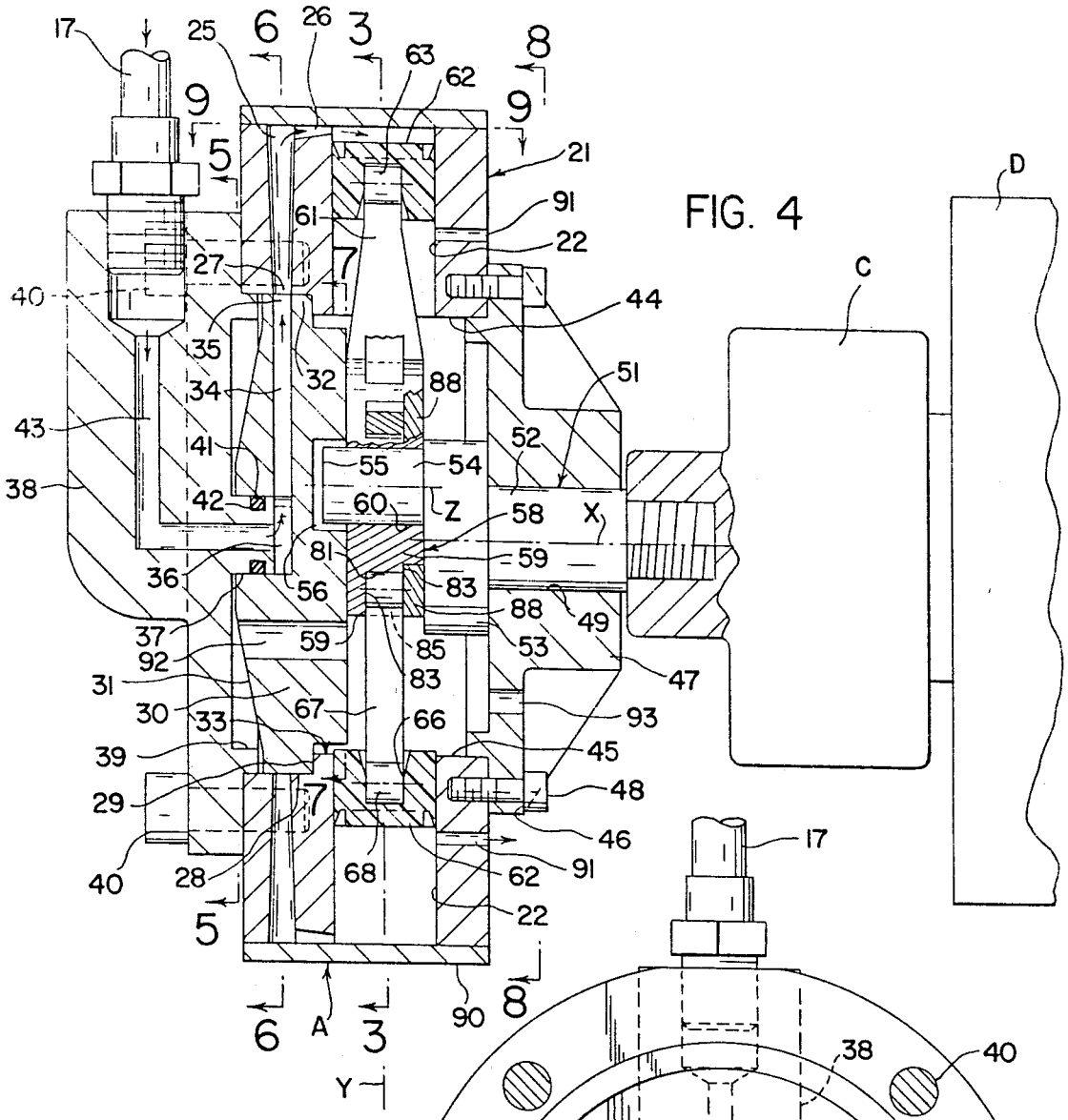
FIG. 4 is a sectional elevation of the engine of FIG. 3, along line 4—4 of FIG. 3 and to the same scale, the engine being shown connected through a clutch to an internal combustion engine of the chain saw of FIG. 2.
Figure 5:
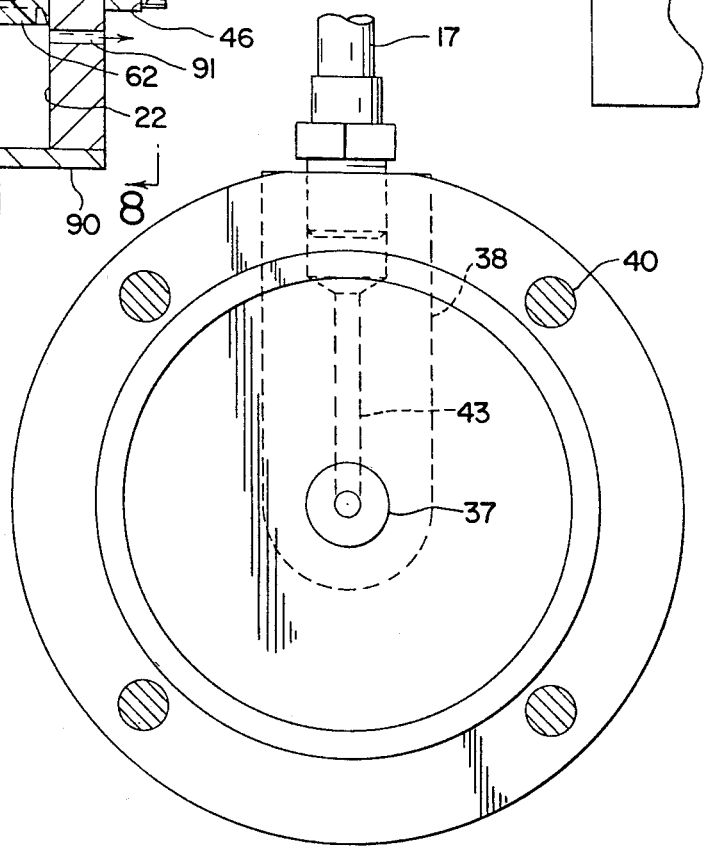
FIG. 5 is a section along line 5—5 of FIG. 4 to the same scale.
Figure 6:
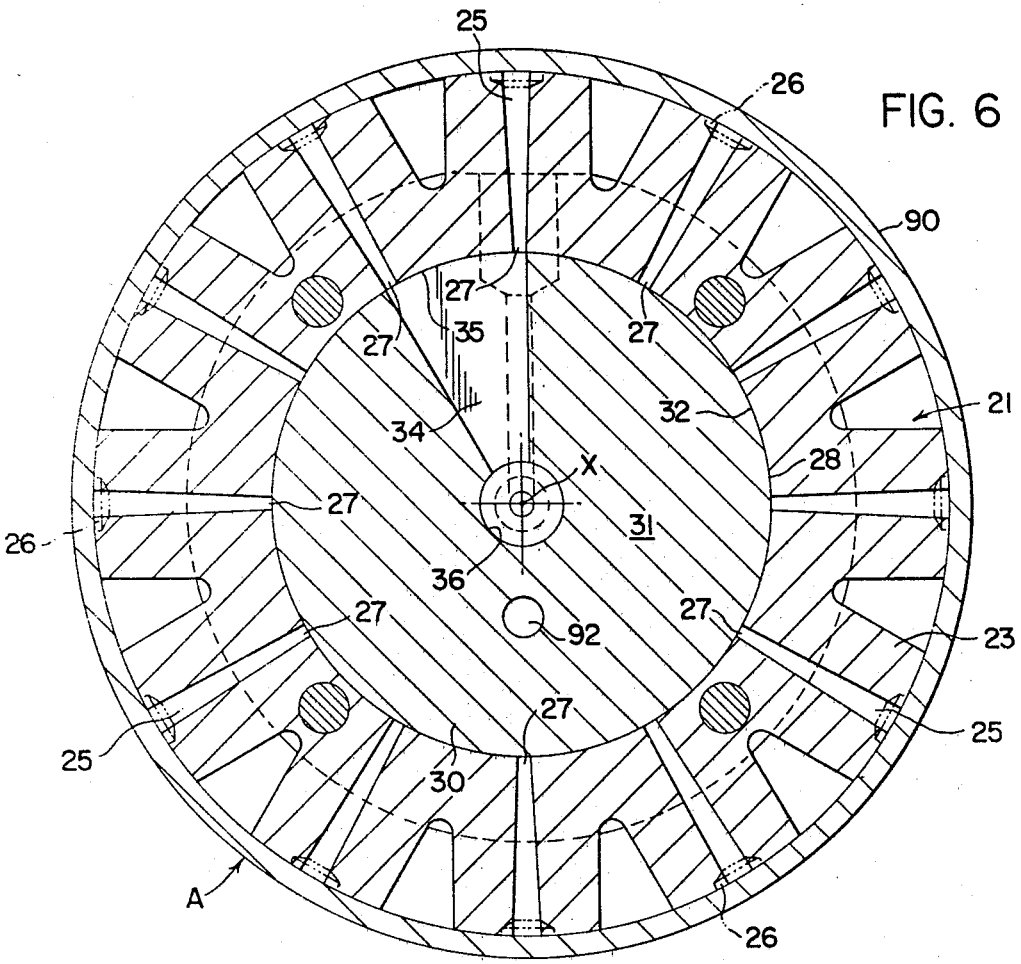
FIG. 6 is a section along line 6—6 of FIG. 4 to the same scale.
Figure 7:
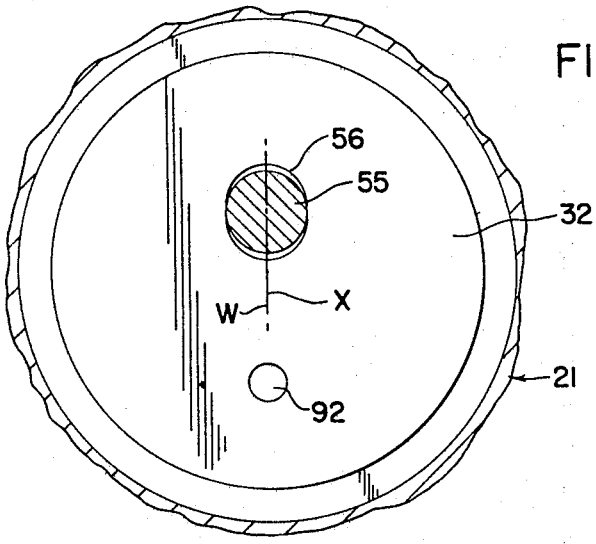
FIG. 7 is a section along line 7—7 of FIG. 4 to the same scale, showing the free end of the crank pin engaging the rotary valve.
Figure 8:
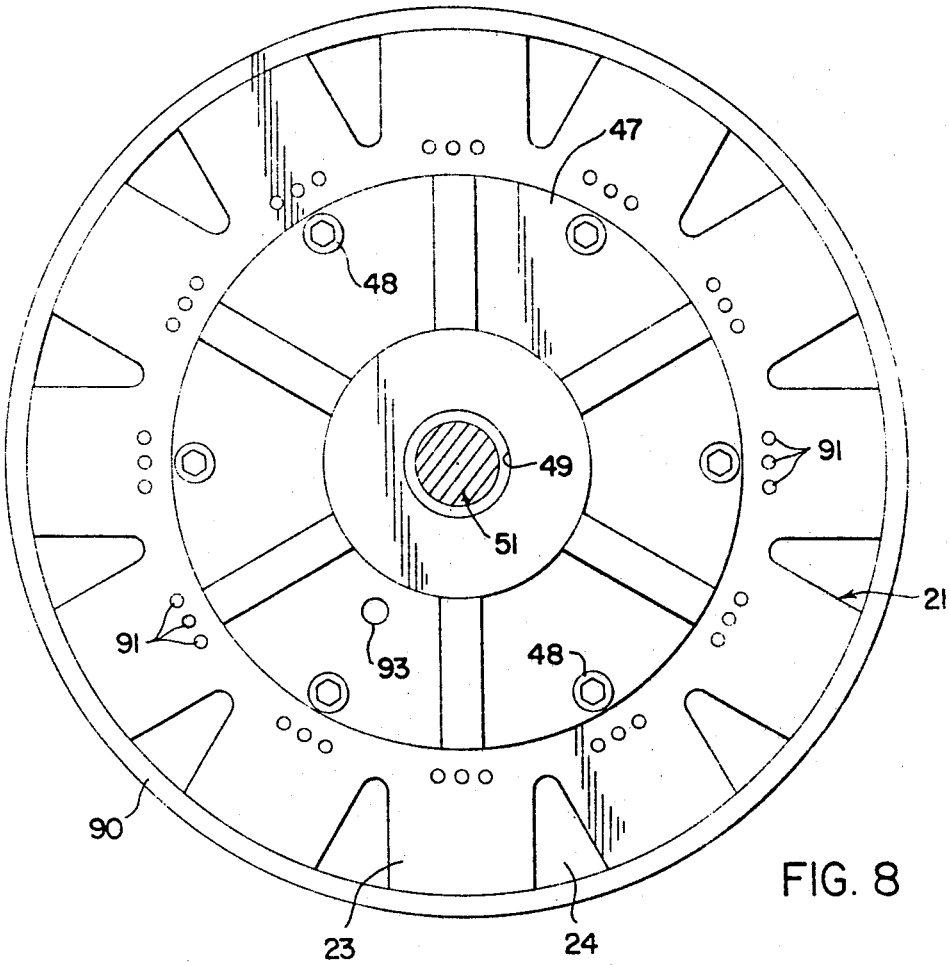
FIG. 8 is a view along line 8—8 of FIG. 4 and to the same scale.
Figure 9:
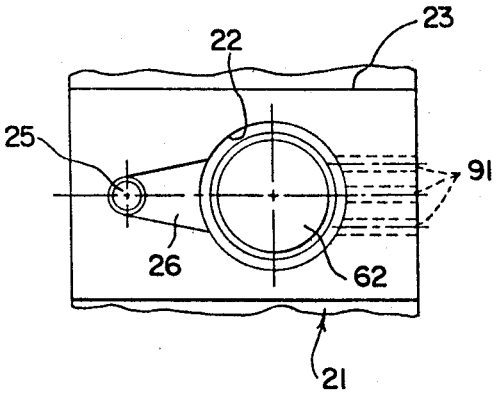
FIG. 9 is a view along line 9—9 of FIG. 4 to the same scale.
Figure 10:
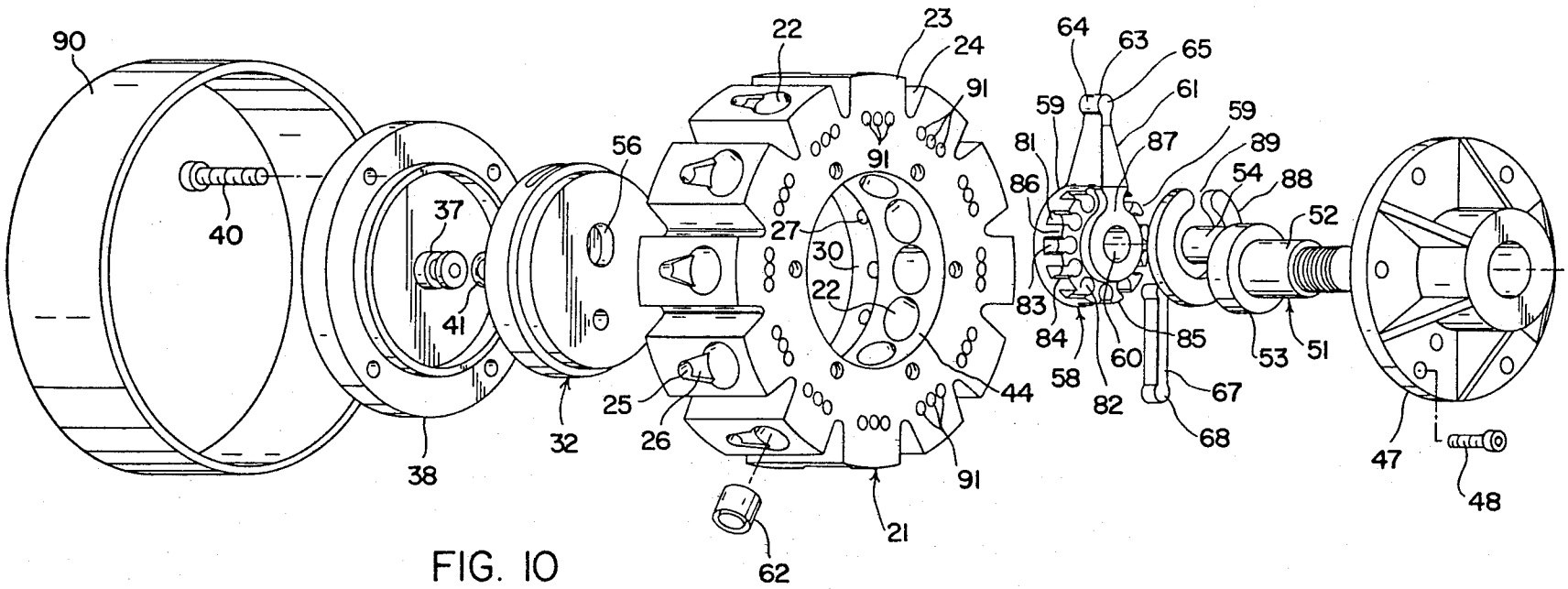
FIG. 10 is an exploded view to a smaller scale of the gas-powered starter engine of FIGS. 1 to 9 inclusive.

Connecting rod mounting means, illustrated in FIGS. 3, 4 and 10 includes a master connecting rod member 58 which is rotatably mounted on crank pin 54. Member 58 has a hub portion 59 having a bore 60 closely rotatably fitting crank pin 54. The hub portion is sufficiently thick to fit closely but movably between crankshaft portion 53 and valve member 31. Member 58 also includes, rigidly fixed to and preferably formed integrally with hub portion 59, a rigid connecting rod 61 that is pivotally connected to one of the identical pistons 62, one of which is slidably mounted in gas-tight relation in each of cylinders 22. Rigid connecting rod 61 has an outer enlarged free end portion 63 the outer curved surface 64 and end surfaces 65 of which define a portion of a cylinder with flat ends. Portion 63 is snapped into and held in place in a mating socket 66 in one of pistons 62.

In the embodiment of FIGS. 1 to 10, however, each of the pistons other than that connected to rigid rod 61, is connected to an individual, freely-pivotable connecting rod 67 which is pivotally connected to master connecting rod member 58, all connecting rods 67 being identical. Each connecting rod 67 has an outer enlarged free end portion 68 identical in shape with portion 63 of rigid connecting rod 61, with an outer curved surface 69 defining a portion of the cylinder and flat ends 70. Enlarged end portion 68 of each rod 67 is snapped into socket 66 of associated piston 62.

Each piston 62 is formed of a stiff, somewhat resilient material, having good wear resistance when slidably engaged with the wall of the associated cylinder which is made of metal, such as aluminum. The material of each piston has such characteristics and its socket 66 is so shaped with re-entrant edge portions 72, that end portion 63 of rigid rod 61 or end portion 68 of rod 67 can be snapped or forced into socket 66 of the piston during assembly by temporary resilient spreading of edge portions 72 of the socket, and the rod end thereafter is firmly but pivotally held or clamped in place during operation of the motor, without the necessity of using retaining rings, pivot pins, screws or retaining means other than the mating shapes of the socket opening and ends of the connecting rods, and the characteristics of the material of the piston. Each piston has, adjacent the open end of its socket 66, a recess 73 with inclined walls **73*a*, 73*b* that guides the free end portion of the associated connecting rod into the socket of the piston and facilitates snapping of the connecting rod end into the piston socket during assembly of the motor. Recess 73** also provides clearance for the pivotally moving connecting rod during operations of the motor. An example of material found suitable for the pistons is a synthetic resin material containing molybdenum disulfide.

Each piston 62 also has a circumferential groove 75 which in the embodiment of FIGS. 1–16 is located at the piston side subjected to pressurized gas during the working stroke of the piston. The groove is of such shape that it defines on the piston a circumferential thin or feather edge 76 that faces the pressurized gas during the piston working stroke and is deflected by the pressurized gas outwardly toward the wall of the cylinder to form an essentially gas-tight seal with the cylinder wall when pressurized gas drives the piston toward the crankshaft in the working stroke of the piston.

Each connecting rod 67 has at its other or inner end an enlarged free end portion 77 which in the embodiment of FIGS. 1–16 is identical in shape with end portion 68 and has a curved outer surface 78 that forms part of a cylinder with flat ends 79 and is held in a socket 81 (FIGS. 3, 4, 10) formed in hub portion 59 of master connecting rod member 58. Each socket 81 has a curved inner surface 82 that mates with and closely fits the curved outer surface 78 of portion 77 of associated connecting rod 67, an inner flat wall 83 and a flared outer recess portion 84 for rod clearance during motor operation, socket 81 being shaped with inwardly extending edge portions 85 that retain end portion 77 of the connecting rod against outward radial movement relative to hub portion 59. Each socket 81 extends and opens into a side wall 86 of hub portion 59, wall 86 being offset inwardly around a central portion 87 of the hub portion. End portions 77 of connecting rods 67 are prevented from moving axially outwardly from sockets 81 by a retainer member 88 that is shaped to fit around central portion 84 and against side wall 83, and by opening 89, to fit against the sides of the base of rigid rod 61, member 88 also being located between side wall 86 of hub portions of member 58 and crank portion 53 of the crankshaft. Member 88 is thus secured against rotational and axial movement relative to hub portion 59, and connecting rods 67 are firmly pivotally connected to hub member 59 of connecting rod mounting member 58 without clamps, pivot pins, screws or other complicated means.

The outer ends of the cylinders are closed by a closure member or ring 90 that is mounted in gas-tight relation on the outer ends of cylinder portions 23 of cylinder block 21. This ring, which is shown as metal, may be secured in place by a shrink-fit obtained by heating the ring itself to expand it and then placing it in position on the cylinder block and allowing it to cool to cause it to contract and be securely mounted. If it is later desired to remove the ring for any reason, the ring can then be heated to expand it and then slipped off the cylinder block. Alternately, the ring may be held in place by suitable adhesive, such as an epoxy type cement; this is desirable if the ring or cylinder block or both are formed of non-metallic material. When the ring is in place, it closes and seals the ends of the cylinders and of radial and transverse conduits 25, 26, and thus insures that all power gas passing through these conduits will pass into the cylinders.

Each cylinder also has one or more openings 91, three in the illustrated embodiment, through which the power gas may be rapidly exhausted to atmosphere when the piston completes its inward stroke toward the crankshaft.

Moreover, closure and supporting members 38 and 47 respectively have openings 92 and 93 opening to the ambient to insure that the interior crankcase portion of the cylinder block will at all times be at atmospheric pressure.

Known clutch C is suitably rigidly mounted on the end of crankshaft 51 as by a threaded connection shown in FIG. 4.

Because of the design of the illustrated embodiment of the invention, it may be readily and very economically manufactured and assembled. Thus, the connecting rods may be molded, or since they are flat, stamped from metal or other suitable material. Cylinder block 21, valve member 31, closure members 38 and 47, and member 58 may be die cast of metal or molded of other suitable material, with only little required machining. Pistons 62 may be readily molded of suitable material, and the crankshaft may be economically manufactured because of its very simple construction utilizing only a single crank throw portion 53.

A preferred method of assembly is as follows, assuming that all of the parts are disassembled as shown in FIG. 10.

Connecting rods 67 without pistons 62 attached, have their ends 77 inserted in sockets 81 in the hub portion of master connecting rod member 58. Retainer member 88 is then placed on central portion 87 of hub portion 59 of the master connecting rod. This subassembly is then mounted by bore 60 on crank pin 54 of the crankshaft. Thereafter this subassembly is manipulated so that all connecting rods 67 and rigid connecting rod 61 are inserted into the cylinders, one to each cylinder. Supporting member 47 then is slid over the shaft portion of the crankshaft, and bolted in place, thus accurately locating the crankshaft and keeping the connecting rods in their respective cylinders.

Pistons 62 then are inserted into the cylinders from their open ends, and each piston is pushed down and snapped over the end of the enlarged portion of its appropriate connecting rod, each connecting rod being manipulated to locate it if necessary, from opening 30 at the other side of the cylinder block. Flared recesses 73 of the pistons aid in guiding the enlarged ends of the connecting rods into alignment with piston sockets 66 so that forces on the pistons will snap the end of the connecting rods into the sockets.

Thereafter valve member 31 is placed in opening 30 and rotated if necessary until its recess 56 engages free end 55 of crank pin 54. The valve member then can be located axially by contact of its radial surface 33 with radial surface 29 of the cylinder block.

Next, closure member 38 is mounted with its hub portion 37 protruding into central recess 36 in the rotary valve member, and is axially located in the proper position, after which bolts 40 are inserted to bolt it in place.

Thereafter, closure ring 90 may be mounted as indicated above. The engine is then assembled ready for use.

In another method of assembly, pistons 62 are first snapped onto the ends of individual connecting rods 67 which at this point are not connected to master connecting rod member 58. These pistons are then slid into their selected cylinders from the crankcase or inner ends of the cylinders. Piston 62 connected to master connecting rod member 58 is also inserted into its selected cylinder either before or after insertion of the other pistons. Inner ends 77 of the individual connecting rods 67 are then inserted into sockets 81 of member 58. Retainer member 88 is then put in place, crank pin 54 is slid through opening 60 of member 58, and supporting member 47 is slid over the free end of shaft portion 52 of the crankshaft onto the shaft portion and bolted in place. The remainder of the engine can be assembled as described above. This procedure is particularly well adapted to a motor in which the outermost ends of the cylinders are not open prior to assembly.

Various modifications may be made in the motor apparatus of the invention discussed above.

Figure 22:
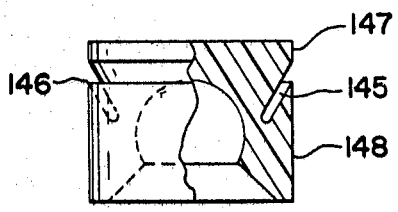
FIG. 22 is a view, partly in section, of another piston embodiment.

As shown in FIG. 22 the pistons may be made with a circumferential slot 145 that extends inwardly and downwardly away from the high pressure side of the piston, to provide a feature edge 146 between the top and bottom edges of the piston, rather than at one edge of the piston as previously described. This feather edge also deflects outwardly to provide a gas seal. Moreover, in this design there are cylindrical portions 147 and 148 on both sides of the slot which can aid in keeping the piston aligned in the cylinder.

FIGS. 23 to 28 inclusive disclose an alternative connecting rod mounting means, alternative designs of individual connecting rods, and an alternative design of a piston, which are shown as designed for use in motor A described previously.

The connecting rod mounting means takes the form of a master connecting rod member 150 (FIGS. 23, 24) having a central hub portion 151 having bore 152 concentric about axis Z adapted to receive crank pin 54 of crankshaft 51, to which hub is affixed a rigid connecting rod 153. This connecting rod has at its outer end an enlarged portion 154 the outer surface of which defines a major portion of a sphere. The hub portion includes two identical flanges 155 separated by a space 156 that extends around the major portion of the hub portion except for the portion that is fixed to rigid connecting rod 153.

A plurality of pairs of identically sized aligned openings 157 in flanges 155 are equiangularly and equidistantly spaced around axis Z except for omission of a pair of openings along a plane extending through the center of the spherical end of the master connecting rod and axis Z.

Each individual connecting rod 158 (FIGS. 25, 26) has a shaft portion 159 and enlarged end portions 160 and 161 each of which is a major portion of a sphere. End portion 160 is identical in size with spherical portion 154 of connecting rod 153, and end portion 161 as shown, may also be identical in size and shape. As shown in FIGS. 23, 24 spherical enlarged portion 161 at one end of each connecting rod 158 is snapped into a pair of aligned openings 157 in flanges 155, either by resilience of the material of which the flanges are formed, or of the material of which end portions 161 of connecting rods 158 are formed or by resilience of both end portions 161 and flanges 155. Connecting rods 158 one of which is provided for each pair of aligned openings 157, are thus firmly pivotally connected to the master connecting rod member so that they will not disconnect during operation of the motor.

Outer spherical unconnected end 154 or 160 of each of connecting rods 153 and 158 is adapted to be snapped into a mating socket 164 in one of the pistons 165 (FIGS. 27, 28), each of which pistons has a circumferential slot 75 defining a circumferential sealing edge 76 as previously described. Socket 164 is shaped to constitute a major portion of a sphere, having an inwardly extending lip 166 between the socket portion and a flared circular frustoconical recess 167. This lip expands to permit the spherical end of the connecting rod to be snapped into the socket, and then contracts, and thus aids in holding or clamping the spherical end portion of the associated connecting rod in the socket while permitting pivotal movement of the rod relative to the piston. Each of the sockets and the end of the connecting rod that goes in the socket is so shaped that the end portion of the connecting rod can be snapped into the socket and held there so that the piston will not detach from the connecting rod during operation of the engine. In the illustrated embodiment the piston of FIGS. 27 and 28 is formed of a stiff resilient non-metallic material which will permit be identical in size and shape. As shown in FIGS. 23, 24 spherical enlarged portion 161 at one end of each connecting rod 158 is snapped into a pair of aligned openings 157 in flanges 155, either by resilience of the material of which the flanges are formed, or of the material of which end portions 161 of connecting rods 158 are formed or by resilience of both end portions 161 and flanges 155. Connecting rods 158 one of which is provided for each pair of aligned openings 157, are thus firmly pivotally connected to the master connecting rod member so that they will not disconnect during operation of the motor.

Outer spherical unconnected end 1654 or 160 of each of connecting rods 153 and 158 is adapted to be snapped into a mating socket 164 in one of the pistons 165 (FIGS. 27, 28), each of which pistons has a circumferential slot 75 defining a circumferential sealing edge 76 as previously decribed. Socket 164 is shaped to constitute a major portion of a sphere, having an inwardly extending lip 166 between the socket portion and a flared circular frustoconical recess 167. This lip expands to permit the shperical end of the connecting rod to be snapped into the socket, and then contracts, and thus aids in holding or clamping the spherical end portion of the associated connecting rod in the socket while permitting pivotal movement of the rod-relative to the piston. Each of the this action to occur.

Master connecting rod member 150 and its associated individual connecting rods 158, may be formed into a subassembly without the pistons, and this subassembly then placed in the cylinder block during assembly of the motor, with the connecting rods extending into the cylinders, after which the pistons are pushed into the cylinders and engaged with the outer ends of the connecting rods, in a manner similar to that previously described.

Furthermore, while the pistons have been disclosed above as formed of stiff non-metallic material which can be deformed sufficiently to permit the ends of metallic connecting rods to be snapped into the sockets in the pistons but resilient enough to firmly pivotally hold the ends of the rods in the sockets of the piston during operation of the motor, the pistons can be made of metal and the piston rods can have at least their end portions made of stiff resilient material which permits them to be snapped into the sockets of the pistons and held therein; or both the piston socket portions and end portions of the connecting rods can be made of metallic, or non-metallic material provided that the above described snap-in and firm pivotal holding actions after snap-in can occur.

An alternative embodiment of motor A identified as motor A′ is disclosed in FIGS. 29–32, and drawing numbers used to identify parts and components of motor A shown in FIGS. 1–16 will identify the same parts and components of motor A′ disclosed in FIGS. 29–32 where applicable. While motor A′ could be manufactured out of metal such as a zinc die casting, motor A′ is preferably made, for the most part, out of common plastic material such as acrylonitrile butadiene styrene (ABS) which, importantly, permits the plastic parts to be economically assembled by ultrasonic welding.

Motor A' includes a unitary plastic cylinder block 21 having a hub portion 200 with a circular inner surface 45 defining a central opening 44. A plurality of hollow cylinder portions 23 extend radially outward from hub portion 200 to define a like plurality of cylinders 22. Disposed at one side of central opening 44 is an axial end face portion 201 contiguous with hub portion 200. A valve drive opening 202 concentric with axis X extends through axial end face portion 201.

Disposed in each cylinder 22 is a plastic piston 62. Disposed within central opening 44 is a master connecting rod member 58 and connecting rod means are provided to secure pistons 62 to connecting rod member 58 thus permitting the connecting rod member to rotate about axis Z while axis Z orbits in a concentric path about axis X. As described hereinabove, connecting rod means includes rigid connecting rod 61, pivotable connecting rods 67, the end portions of the rods and the socket portions of piston 62 and those formed in the hub portion 59 of connecting rod 58. Hub portion 59 of master connecting rod member 58 has a bore 60 extending therethrough concentric about axis Z.

Welded to the open side of central opening 44 or the side opposite axial end face portion 201 is a support member 47 having an opening 49 concentric about axis X extending therethrough. A metal crankshaft 51 having a shaft portion 52 is journaled in support member's opening 49 and has a crank pin portion 54 offset from shaft portion 52 a predetermined distance rotatably received in bore 60 of hub member 59.

Figure 29:
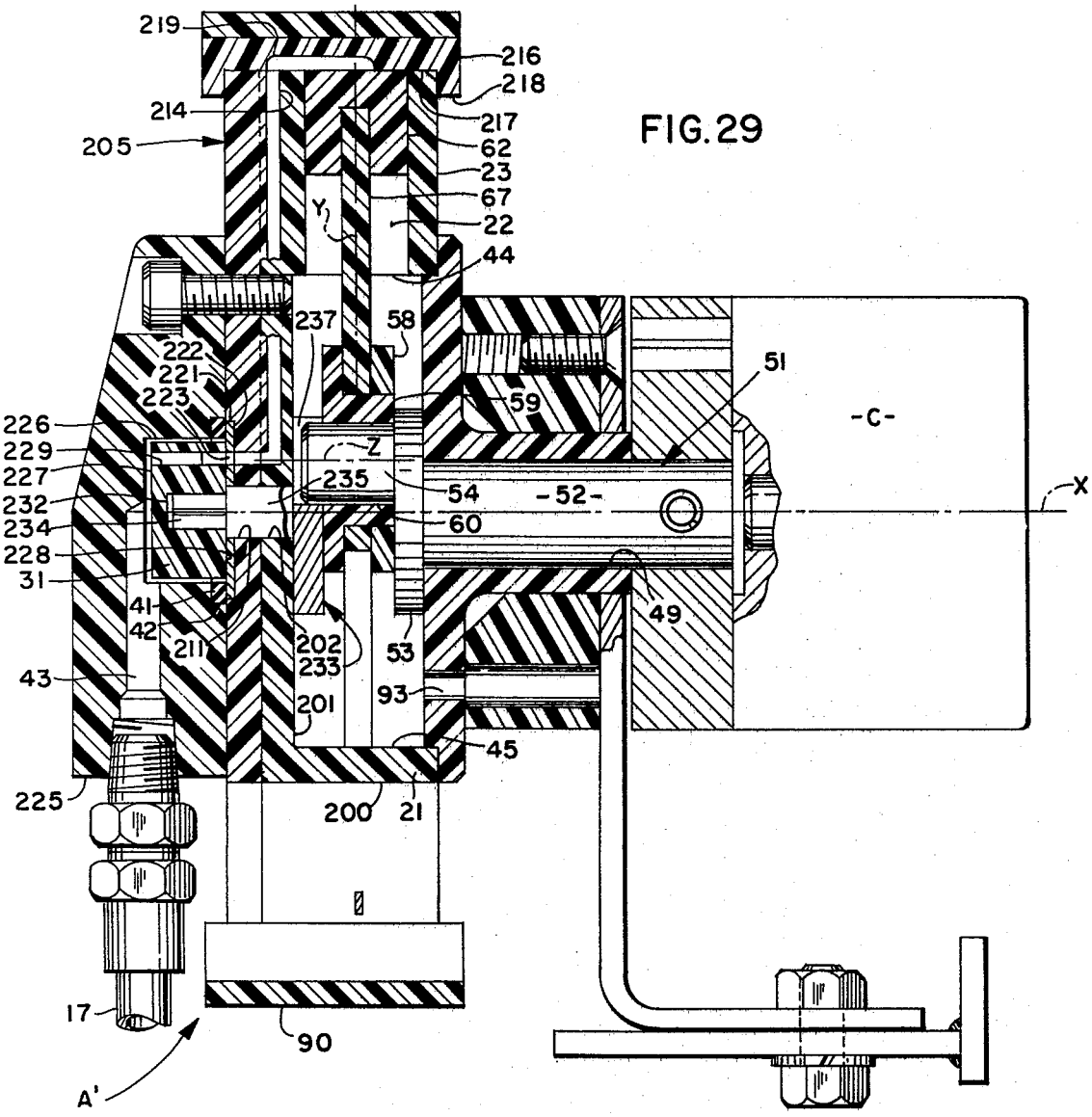
FIG. 29 is an offset sectional view, similar to FIG. 4, of an alternative embodiment of the motor.
Figure 31:
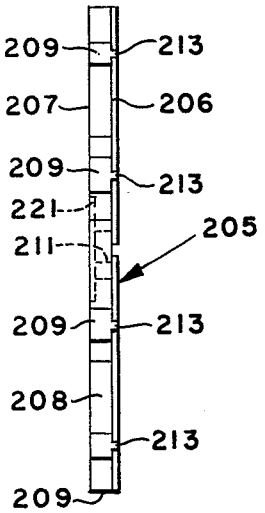
FIG. 31 is a side view of the backplate shown in FIG. 30.
Figure 30:
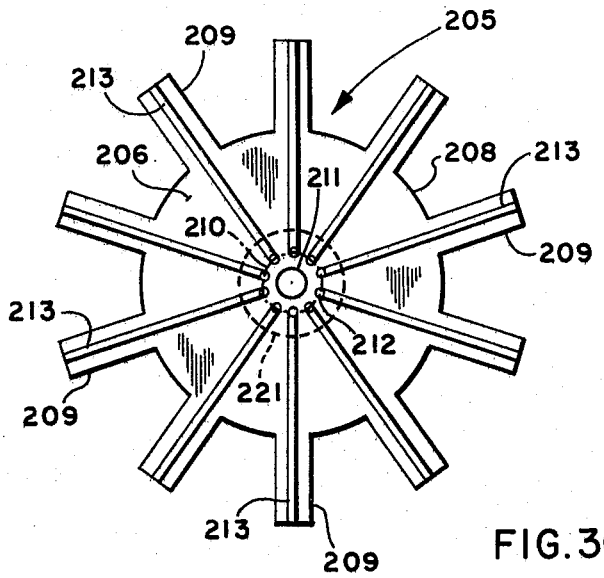
FIG. 30 is a plan view of the backplate of the motor shown in FIG. 29.

Secured to and formed with axial end face portion 201 is motor backplate means containing commutator valve 31 and forming radial gas inlet passages 204 adapted to be in fluid communication with cylinders 22. Motor backplate means includes a spider plate 205 as shown in FIGS. 30 and 31 which basically is a flat plastic plate having a generally flat inner surface 206 adapted to be ultrasonically welded to axial end face portion 201 and an outer flat surface 207. Spider plate 205 includes a circular base portion 208 of a diameter equal to that of hub portion 200 and from which a plurality of leg portions 209 equal in number to that of cylinder portions 23 extend radially outwardly to the periphery of unitary cylinder block 21. In the center circular base portion 208 is a central valve drive opening 211 of size equal to that of valve drive shaft opening 202. A plurality of axial gas inlet passages 121 extend through spider plate 205 and are arranged in equally spaced increments about a circle 210 concentric with central valve opening 211. Axial inlet passages 212 correspond in number to cylinders 22 of motor A'. Protruding from inner surface 206 and extending radially outwardly from each axial inlet passage 212 to the edge of leg portion 209 and aligned with each axial inlet passage 212 is a radial passage sealing rib 213. Molded into the exposed, back side surface of axial end face portion 201 is a plurality of radially extending open channels 214 (equal in number to cylinders 22), each channel 214 being formed at a point approximately equal to the position of an axial inlet passage 212 and extending radially outwardly to the periphery of unitary cylinder block 21 (FIG. 29). Sealing ribs 213 lock into channels 214 to serve as positioning means for accurately locating spider plate 205 to axial end face portion 201. When spider plate 205 is ultrasonically welded to axial end face portion 201, sealing ribs 213 fuse to the side of radial channels 214 to define radial gas inlet passages 204 (FIG. 29) although, as an option in the motor assembly procedure, tubing (not shown) may be inserted in channels 214 to insure uniform radial passage size during welding. The tubing may then be withdrawn after welding or left in the assembly.

The top of each cylinder 22 is closed by a cap 216 which has a recess 217 at one side thereof defined by a peripherally extending shoulder 218 which extends about and engages the sides of each cylinder portion 23 and corresponding leg portion 209. Within each recess 217 of each cap 216 there is formed an axially extending cap passage 219 which provides fluid communication between associated radial gas inlet passage 204 and the top of cylinder 22 (FIG. 29).

As shown in FIGS. 29, 30, 31, outer surface 207 of spider plate 205 has an annular recess 221 formed therein concentric about central valve opening 211 and larger in diameter than circle 210 on which axial inlet passage 212 lie. Disposed in annular recess 221 is a metal, flat valve plate washer 222 (FIG. 29) having a plurality of openings 223 of the same size and circular location as axial inlet passages 212; valve plate washer 222 having an opening receiving a protrusion extending from recess 221 to insure alignment of openings 223 and axial inlet passages 212 (not shown).

Backplate means also includes a plastic valve cover inlet 225 mounted as by fasteners to spider plate 205 and unitary cylinder block 21. Valve cover inlet 225 has a cylindrical blind bore 226 concentric with central valve opening 211 and opening to spider plate 205. Sealing blind bore 226 to prevent leakage between valve cover inlet 225 and spider plate 205 is an O-ring 41 in an annular groove 42 formed in valve cover inlet 225. Communicating with the rear or closed portion of blind bore 226 is a main gas inlet passage 43 which is suitably threaded to receive a tube 17 supplied with pressurized gas. Rotatably disposed within blind bore 226 is a cylindrical, commutator-type valve 31, preferably manufactured from molybdenum disulfide or other suitable material. The axial end face 227 of commutator valve 31 adjacent the closed wall of blind bore 226 is shown with a single valve inlet opening 229 extending in an axial direction partially through commutator valve 31 whereat valve inlet opening 229 is expanded into an arcuate opening 230 (FIG. 33) which opens to the opposite axial end face 228 of commutator valve 31. The center of arcuate opening 230 is defined by a radius R which is equal to that of circle 210 defining the position of axial inlet passages 212. Importantly, the length of arcuate opening 230 is sized to be in fluid communication at any given instance of commutator valve's rotation with at least one axial inlet passage 212 but not more than three axial inlet passages 212. Preferably, the valve timing spans between 1.5 and 2.5 axial inlet passages 212. The diameter of valve inlet opening 229, axial inlet passages 212, radially extending inlet passages 204 and cap axial passages 219 are approximately equal to one another.

Figure 32:
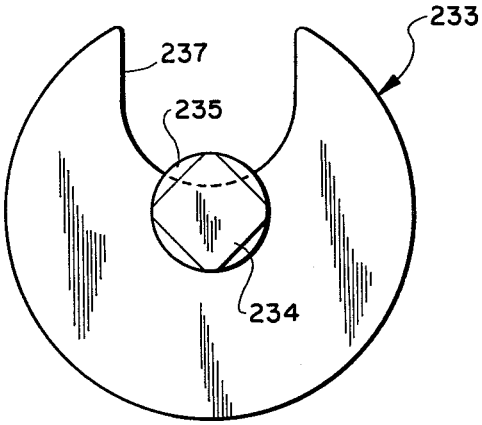
FIG. 32 is an end view of the valve drive shaft employed in the motor shown in FIG. 29.
Figure 33:
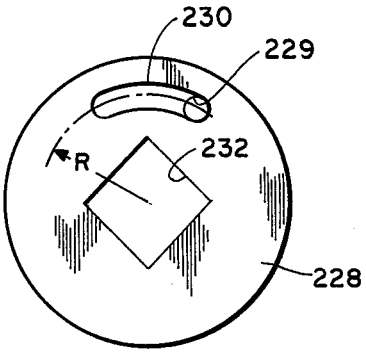
FIG. 33 is an end view of the commutator valve of the motor shown in FIG. 29.

Referring now to FIGS. 29, 32 and 33, opposite axial end face 228 of commutator valve 31 has a blind square opening 232 which receives in snug engagement a square end 234 of a valve drive shaft 223. Adjacent square end portion 234 of valve drive shaft 233 is a cylindrical bearing portion 235 which is journaled in central valve opening 211 of spider plate 205 and valve drive shaft opening 202 in axial end face portion 201. Depending from central bearing portion 235 is an offset circular drive portion 236 which has a C-shaped opening 237 formed therein. Crank pin portion 54 of crankshaft 51 extends into C-shaped opening 237 thus rotating valve drive shaft 233 to rotate commutator valve member 31. It should be clear from the foregoing that when the motor is charged with gas, O-rings 41 are effective to prevent radial leakage while axial leakage is effectively minimized since the force developed by gas pressure acting through arcuate opening 230 is more than overcome by the gas pressure acting over the area of the entire axial end face 227.

A ring or prestress member 90 (FIG. 29) is shrunken over caps 216 to prestress cylinder block 21 and, in particular, cylinder portions 23 and hub portion 200 of cylinder block 21. It is contemplated that ring 90 is made from the same plastic material as that used in cylinder block 21 and is snapped over caps 216 immediately after molding of the ring whereupon cooling of the ring will place cylinder portions 23 in compression along with ring stresses developed in hub portion 200. The prestress thus placed on the cylinders is dependent upon the mass of ring 90. When motor A' is operated, commutator valve 31 ports gas to adjacent cylinders 22 in a circular motion. If cylinders 22 were numbered consecutively in a clockwise direction, at a given instant during motor operation cylinders 1, 2 and 3 may be pressurized while in the next instant of operation cylinders 2, 3 and 4 may be pressurized, etc. The forces developed in each cylinder from gas pressure act against the top of each cylinder tending to pull cylinder position 23 away from hub portion 200 while the force acting against the bottom of the cylinder is transmitted to piston 62, the connecting rod mechanism and crankshaft 51. It has been determined that the outward cylinder forces are of such magnitude that hub portion 200 is deflected into a "pear-shape" form that follows the pressurized cylinders as they rotate about the cylinder block when pressurized. The distortion has been estimated as high as 0.006 inch and, not surprisingly, produced fatigue cracks at the juncture of cylinder portion 23 with hub portion 200. This distortion and the resulting stress developed at the juncture of cylinder and hub portions is reduced to an acceptable level by the compressive prestress induced in cylinder portion 23 and the prestress induced on hub portion 200 by ring 90 which must be overcome by the stress produced by the gas in cylinders 22 before deflection can occur.

An acceptable prestress level may be achieved if the top surfaces of caps 216 are formed arcuate to match the inner surface diameter of the ring. Alternatively, the top surfaces of the caps may be flat, in which instance the inner surface of ring 90 would be molded with angularly spaced flats corresponding in number to the number of caps 216. Ring 90 need not be used if cylinder block 21 is made of metal.

STARTER SYSTEM

As shown in FIGS. 2, 17, 18, 35 and 36, the gas powered starting system for starting small two and four cycle internal combustion engines comprises an energy cell 11 containing a source of liquified gas, a motor A or A', a clutch C permitting the motor to drive the engine through its cycles for starting same and a metering valve arrangement adapted to be in fluid communication with energy cell 11 and motor A and operable to meter a predetermined amount of gas from energy cell 11 to motor A sufficient to enable the motor to start the engine. As shown in FIGS. 2, 17, 18 and 35, the metering valve means may take the form of a control valve unit 13 in combination with a plenum chamber 16. Specifically disclosed is a conduit 12 which connects energy cell 11 with valve unit 13. Valve unit 13 is connected by charge and discharge conduits 14, 15, respectively, to plenum chamber 16 and conduit 17 connects valve unit 13 with motor A. When valve unit 13 is actuated for charging the plenum, gas passes through conduits 12, 14 to plenum chamber 16 which holds a predetermined volume of gas for operating motor A. When released by valve unit 13, pressurized gas passes from plenum chamber 16 through conduit 15 back to valve unit 13 which permits this discharge through conduit 17 to motor A. Plenum chamber 16, of which four other embodiments will be discussed hereafter, insures that on a starting cycle there is used only a predetermined volume of pressurized gas calculated to rotate crankshaft 51 at sufficient speed and torque to provide desired starting action of the internal combustion engine D of a power chain saw, lawn mower or other implement without using an excessive amount of gas.

Figure 18:
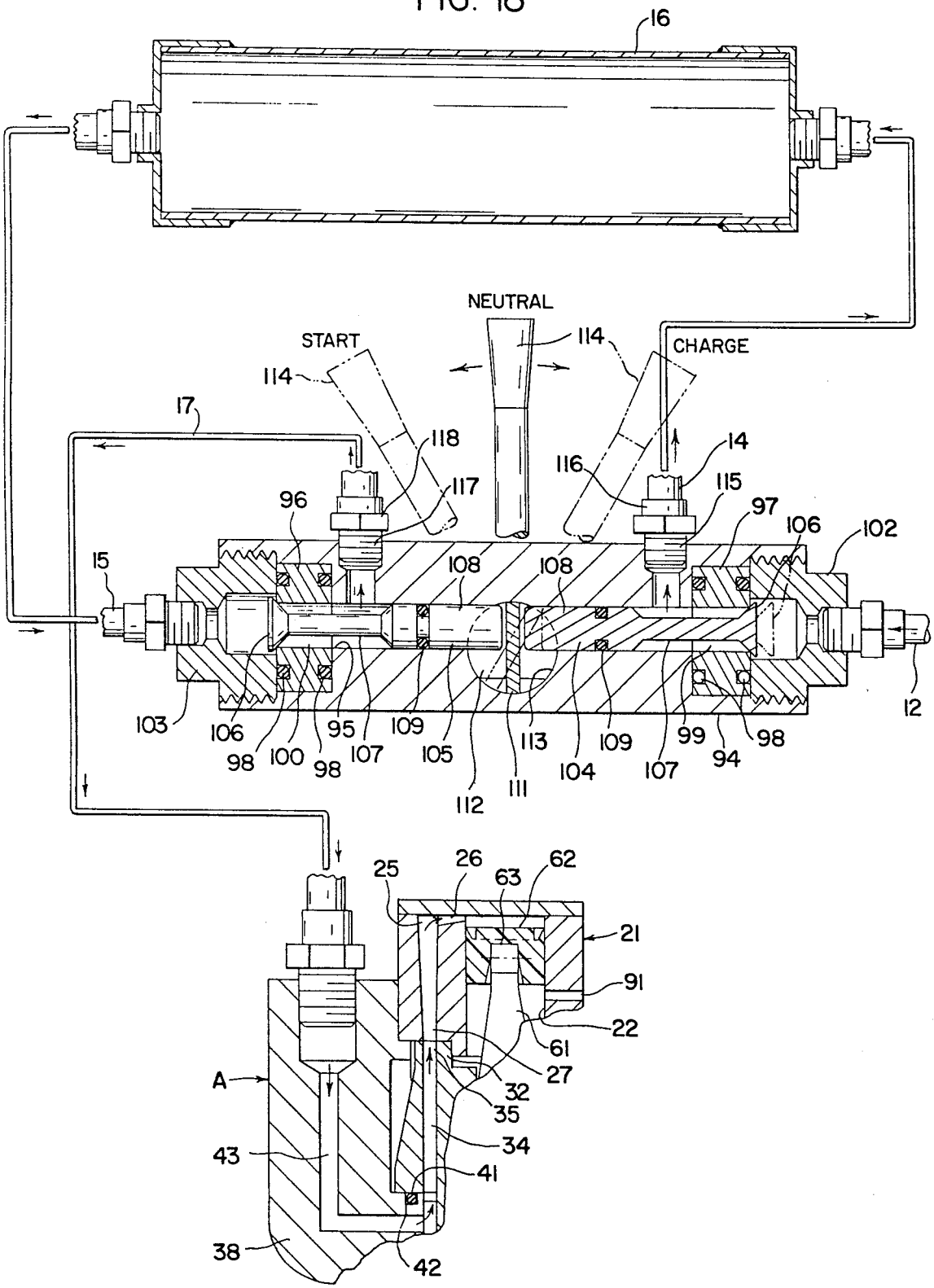
FIG. 18 is a sectional elevation through the control valve of FIG. 17.

As shown in FIG. 18, valve unit 13 comprises a body 94, shown of generally square cross section, which has a bore 95 of generally circular cross section extending longitudinally through it. The ends of the body are recessed to provide space for valve seats 96, 97 which may be made of metal or suitable synthetic resin material, preferably with O-rings 98 disposed in grooves in the valve seats to insure against escape of gas. The valve seats respectively have openings 99, 100 constituting prolongations of bore 95 in the housing. The valve seats are respectively held in place by adapter members 102 and 103 threaded into the end of the housing to bear against the valve seat to hold it in place. Adapter member 102 carries a threaded connector for conduit 12, and member 103 carries a connector for conduit 15.

Two oppositely extending valve stems 104 and 105 are located in bore 95 of the housing and the valve seat openings, each valve stem having a valve head 106 adapted to seat in gas-tight relation against its associated valve seat, and connected by a neck portion 107 to a piston portion 108 of the valve stem that closely fits in bore 95 and is sealed to it by an O-ring 109 in a groove in the piston portion.

Each valve stem is adapted to be moved in a direction which lifts the valve head from the valve seat by a vane 111 mounted on one end of a valve rotor 112 journaled in an opening 113 in housing 94 extending transversely of bore 95, the valve rotor having a lever type handle 114 rigidly fixed to its other end, to permit the rotor vane to be turned in either direction.

The valve body also has an opening 115, communicating with bore 95 at the neck portion of valve stem 104, in which is threaded a connector 116 for conduit 14. It also has another opening 117 communicating with bore 95 at the neck portion of the other valve stem 105, in which is threaded a connector 118 for conduit 17 extending to motor A.

Figure 17:
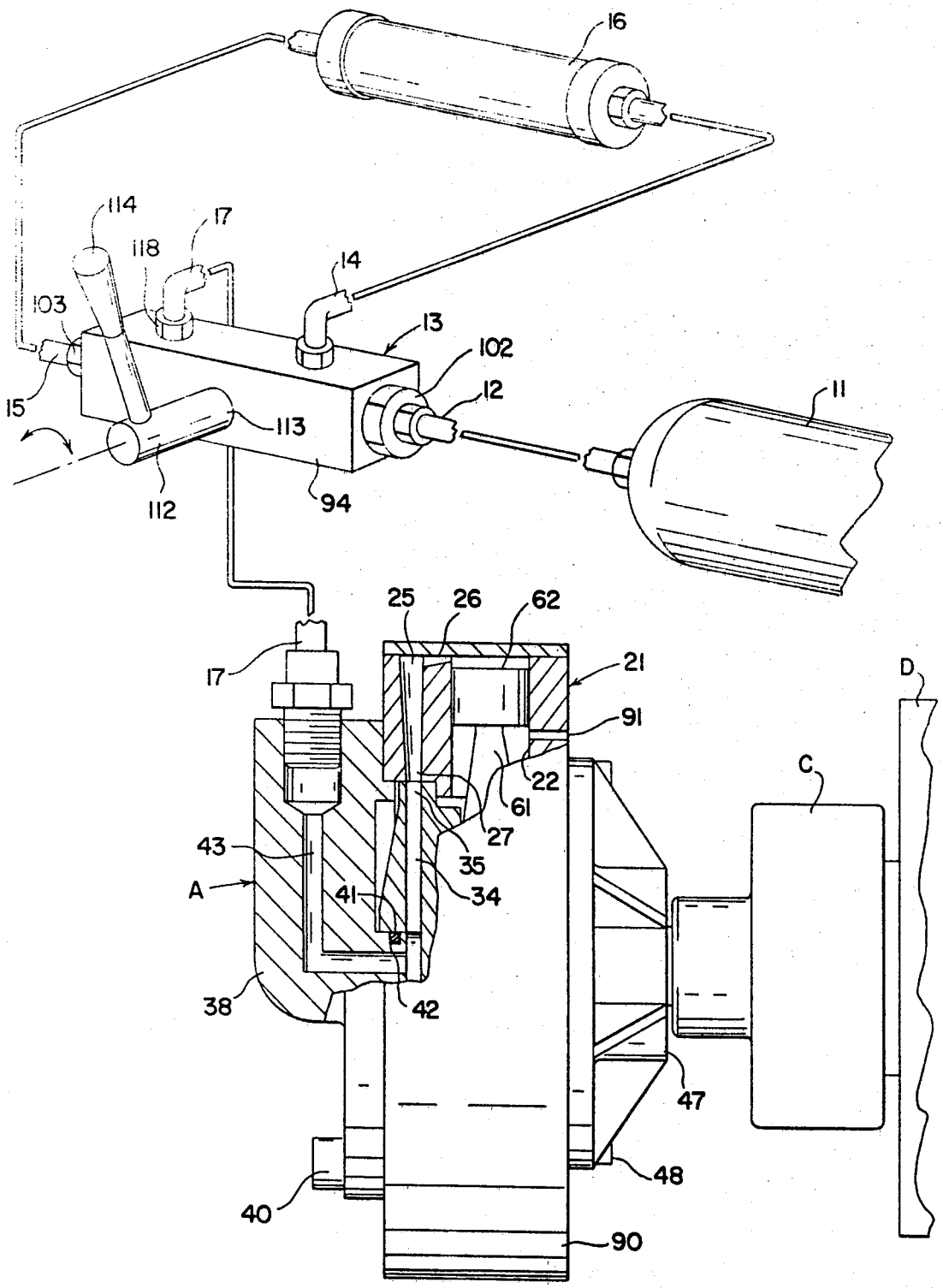
FIG. 17 is a diagrammatic view of a power gas control system embodying the invention shown as used with the above described motor.

It is apparent that when handle 114 is partially turned clockwise in FIGS. 17 and 18, vane 111 will move valve stem 104 outwardly so its valve head 106 will lift from its seat 96, as shown in broken lines in FIG. 18, permitting gas under pressure to pass from energy cell 11 past neck portion 107 of the stem into plenum chamber 16 to fill it with gas under the pressure of the energy cell. When the handle is moved to its center position, vane 111 is in the center position shown in full lines in FIGS.

17 and 18, the gas in conduit 12 causes the valve head of valve stem 104 to seat against valve seat 96 and cut off the flow of gas from the energy cell. When handle 114 is partially turned counterclockwise, vane 111 pushes valve stem 105 outwardly and causes its valve head to lift from its seat 97 as shown in broken lines in FIG. 18, permitting gas under pressure to pass through conduit 15 from the plenum chamber into the end of the valve unit, past the valve head and neck portion of the valve and through conduit 17 to motor A. This delivers to the motor an amount of power gas determined by the volume of the plenum chamber.

Figure 19:
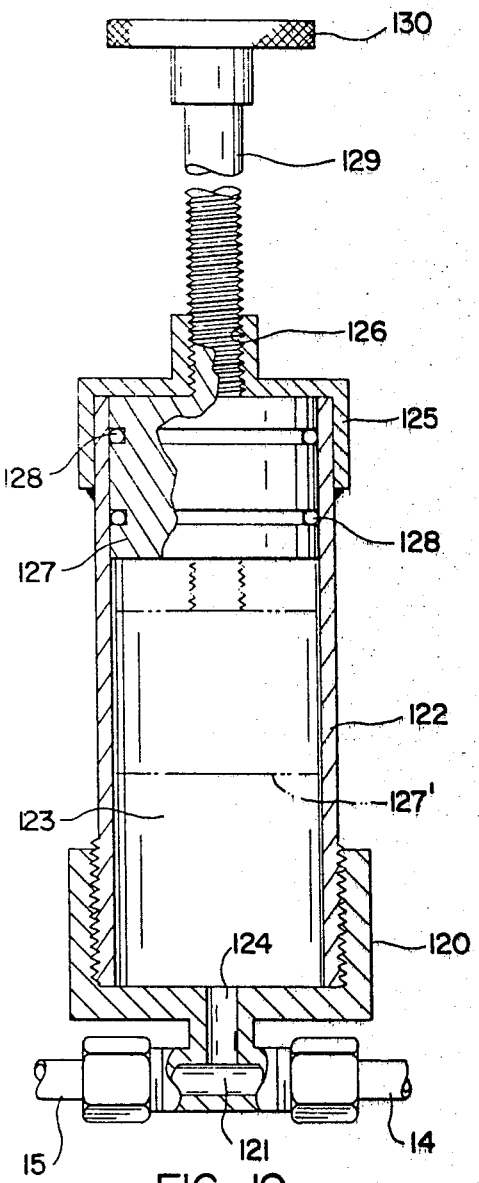
FIG. 19 is a section through a plenum chamber that may be used in the system of FIG. 17.

The plenum chamber may, if desired, be a variable volume plenum chamber such as shown in FIG. 19. This plenum chamber comprises a base 120 having a passage 121 connected to conduits 14 and 15 communicating with valve unit 13. A cylinder member 122 is threaded at one end gas-tightly into base 120; its interior 123 communicates through passage 124. Member 122 is also fixed at its other end gas-tightly to an end member 125 having a central internally threaded opening 126. A piston 127 is slidably mounted in cylinder member 122, O-rings 128 being provided to insure gas tightness; it is connected to a piston rod 129 having external threads engaging the internal threads of member 125. By manual rotation of handle 130 on the piston rod, the piston can be moved axially of the cylinder to adjust the volume of the plenum chamber, as shown in broken lines 127', the threaded connection between the piston end and member 125 holding the piston in its adjusted position. Reduction of the volume is advantageous as a gas economy measure when the starter motor is being used to start a hot internal combustion engine.

Figure 20:
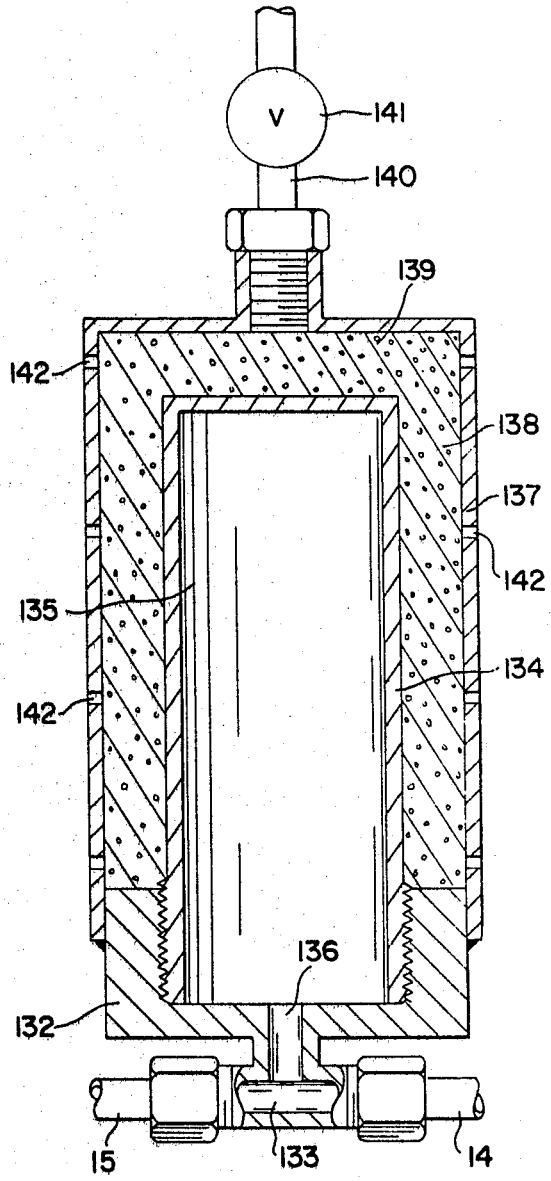
FIG. 20 is a section through another plenum chamber that may be used in the system of FIG. 17.

Another type of plenum chamber that can be used is shown in FIG. 20. This plenum chamber is adapted to be heated to heat the pressurized gas so that a smaller volume of gas will be used on rotating the gas powered motor. This plenum chamber comprises a base member 132 having a passage 133 to which are connected conduits 14 and 15 communicating with valve unit 13. A pressure resistant housing 134, the interior 135 of which is closed except for the gas passage 136 is threaded gas-tightly into communicating with passage 133, of base member 132.

An outer housing or enclosure shell 137 is mounted on base member 132 to surround housing 134 to provide a substantially enclosed space 138 between housing 134 and 137. This space contains a suitable catalytic material 139 such as platinum sponge-aluminum oxide catalyst, which will cause combustion of a suitable hydrocarbon fuel material such as butane gas, of which a suitable amount is introduced into space 138 from a suitable source such as conduit 140 connected to a small commercially available tank of fuel, not shown, through valve 141. Suitable openings 142 are provided in shell 137 to introduce air containing oxygen for combustion purposes.

The volume of interior 135 of housing 134 can be such that when heated by hydrocarbon fuel introduced into the catalyst the pressurized power gas in interior 135 will be heated, and the volume and pressure of the heated power gas will be sufficient to provide the desired rotation of motor A to effect starting of engine D.

Figure 21:
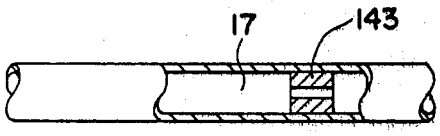
FIG. 21 is a detail showing gas flow restricting means in a conduit to the motor.

Of course, a combination of features of the two illustrated plenum chambers may be used to provide a variable volume plenum chamber adapted to be heated. Furthermore, if desired to further increase economy of gas consumption, suitable flow-restricting means such as apertured ring 143 (FIG. 21) can be provided to reduce the gas passage area of conduit 17 extending between valve unit 13 and motor A.

Figure 34:
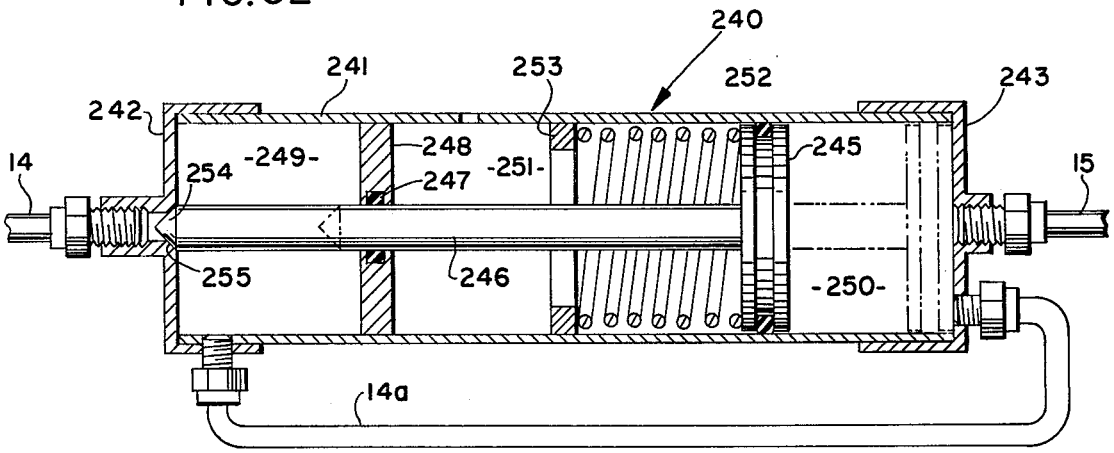
FIG. 34 is a section through a plenum chamber that may be used in the system of FIG. 17.

A third plenum, as shown in FIG. 34, is defined as a spring assisted, constant pressure plenum 240. Constant pressure plenum 240 is defined as a fabricated cylinder member 241 having an inlet end face 242 threadingly receiving charge conduit 14 and an outlet end face 243 threadingly receiving discharge conduit 15. Sealingly disposed within the bore of cylinder member 241 is a piston 245 which has a cylindrical valve guide rod 246 extending from one side thereof. Valve guide rod 246 is sealingly and slidingly received within an O-ring 247 received in turn within an opening formed in an internal wall partition 248 slightly displaced from inlet end face 242. Internal wall partition 248 divides the interior of cylinder member 241 into a sealed inlet chamber 249 on one side thereof and, on its opposite side, an atmosphere chamber 251 extending to piston 245. Between piston 245 and outlet end face 243 is a sealed outlet chamber 250. Sealed inlet chamber 249 is communicated with seal outlet chamber 250 by means of exterior conduit 14*a*. A compression spring 252 seated between one side of piston 245 and an annular flange 253 disposed in atmosphere chamber 251 biases piston 245 towards outlet end face 243. The end of valve guide rod 246 is formed as a truncated cone to function as a valve member 254 adapted to sealingly engage a similarly shaped valve seat 255 formed in the opening of inlet end face 242 which receives charge conduit 14.

When constant pressure plenum 240 is uncharged, spring 252 forces piston 245 against outlet end face 243 and piston 245 is placed in the position shown by the dot-dash lines in FIG. 34. When valve unit 13 is actuated to charge constant pressure plenum 240, gas under pressure enters inlet chamber 249 and is communicated via conduit 14*a* to outlet chamber 250. As the gas pressure begins to build, piston 245 compresses spring 252 against annular flange 253 until the pressure reaches a predetermined value whereat valve member 254 sealingly engages valve seat 255. At this point, both inlet and outlet chambers 249, 250 are charged with gas at a predetermined pressure. When valve unit 13 is actuated to communicate the plenum with motor A or A', the gas is initially dispersed at the predetermined pressure with the force of spring 252 assisting the dispersion of the gas to maintain the gas pressure more nearly constant as a function of time than that disclosed in the plenums of FIG. 19. Valve unit 13, of course, prevents gas from entering conduit 14 when gas in outlet chamber 250 is released to the motor. Since piston 245 automatically or in a self-regulating manner prevents gas from entering sealed inlet and outlet chambers 249, 250 at a predetermined pressure, the amount of gas used to charge constant pressure plenum 240 when the temperature and pressure of the gas in energy cell 11 increases is not significantly different than that used when the gas is at lower temperatures.

Figure 35:
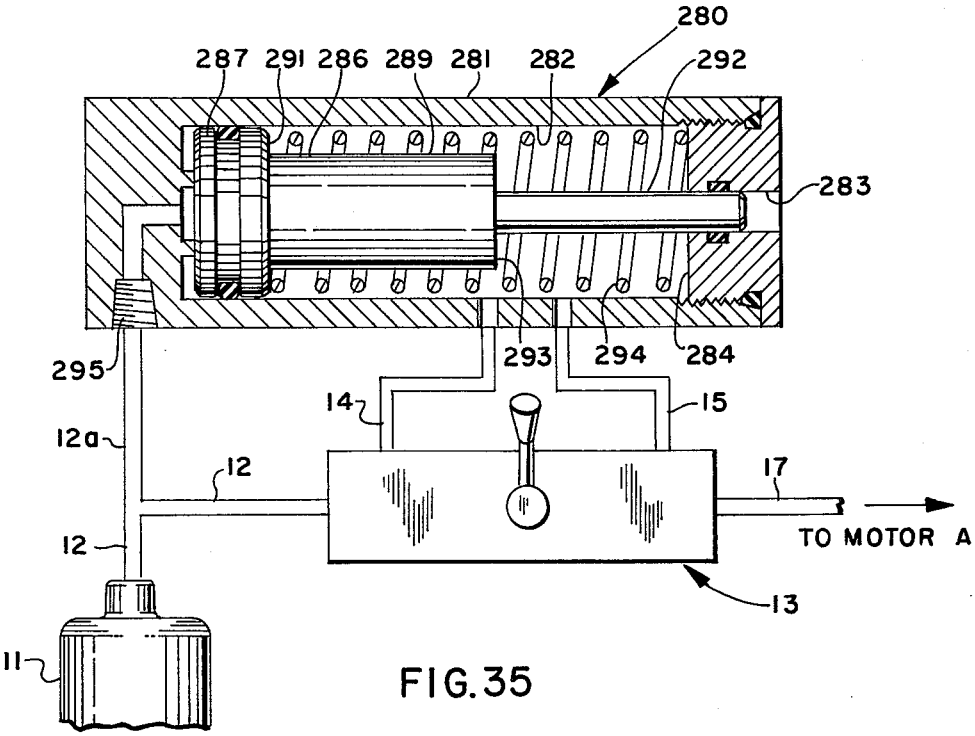
FIG. 35 is a diagrammatic view of a system similar to that in FIG. 17 with a sectional view of a plenum used therein.

A fourth type of plenum arrangement defined as an automatic variable volume plenum 280 is shown in FIG. 35. Automatic variable volume plenum 280 is defined by a cylinder 281 having a blind cylindrically stepped bore extending therein defined by a large bore portion 282 and a small bore portion 283, with the juncture of the two bore positions 282, 283 defined by an annular seat 284. Disposed within the bore of cylinder 281 is a cylindrically stepped piston 286. Cylindrically stepped piston 286 has a large head portion 287 in sealing, sliding enagagement within large bore porton 282 and an intermediate cylindrical portion 289 of fixed length depending from one side of piston head portion 287. The juncture of head portion 287 and intermediate portion 289 is defined by an annular bias surface 291 of predetermined area. A still smaller diameter rod portion 292 depends from intermediate portion 289 and is in sealing, sliding engagement with smaller bore portion 283. The juncture of rod portion 292 and intermediate portion 289 is defined as an annular abutment surface 293 adapted to contact seat 284 when piston 286 moves rearward in the bore. Disposed between one side of head portion 287 and seat surface 284 is a spring 294 biasing piston 286 towards the front of the bore.

In fluid communication with large bore portion 282 at one side of piston head portion 287 is a passage 295 adapted to be in fluid communication with conduit 12*a*, in turn in permanent fluid communication through a suitable "T" fitting with energy cell 11. In fluid communication with large bore portion 282 on the opposite side of piston head portion 287 are valve charge and discharge conduits 14, 15 respectively. Valve conduit 17 leads from valve 13 to motor A or A'.

In operation and with valve 13 unactuated or in a neutral position, when the temperature of the gas in the energy cell reaches a predetermined value, the gas pressure in passage 295 overcomes the bias of spring 294 and forces piston 286 to move rearward in the bore until abutment surface 293 contacts seat 284. In this position, the volume, V-1, of variable volume plenum chamber 280 comprises the annular space in large bore portion 282 existing around intermediate piston portion 289. When the valve member is actuated to its charged position, gas from conduit 14 fills volume V-1, and exerts a pressure against bias surface 291 to develop a force which when added to the compression force of spring 294 is insufficient to overcome the force of the gas in passage 295 which acts over the entire area of piston head portion 287. Piston 286 does not move, and the volume, V-1, remains constant. When the temperature of the gas in energy cell 11 is reduced in value to a predetermined temperature, and accordingly a predetermined pressure, actuation of valve 13 to its charge position will result in a force acting over bias surface 291 which when added to the compression force of spring 294 will lift abutment surface 293 away from seat 284. When this occurs, the gas will act over the entire area of piston head portion 287 to place the piston in equilibrium and the force of spring 294 will be more than sufficient to move the piston forward in the bore to define a much larger volume V-2. Because a larger amount of gas is used to fill a given volume at higher gas temperatures, the energy requirements of the system are conserved in an automatic manner. For example, with liquified $CO_2$ gas in energy cell 11, volume V-1 which would exist at temperatures of 88° F and above would have a volume of 0.5 cubic inch and a gas temperature of 88° F would result in 3.7 grams of gas stored into the 0.5 cubic inch volume. If the temperature of the gas were reduced to 50° F, the volume of the variable volume plenum chamber would expand to V-2 having a value of 2 cubic inches and such volume would contain 4.4 grams of $CO_2$ (saturated vapor). Furthermore, in the V-2 position of variable volume plenum 280, the pressure from energy cell 11 would always bias piston 286 when the gas stored in large bore portion 282 would be exhausted through valve 13 to the motor thereby resulting, at least for part of the travel of piston 286, in a constant pressure release of the charged gas.

Furthermore, it may be possible to modify automatic variable volume plenum 280 so that the first volume V-1 would automatically adjust itself to lower volumes as gas temperatures increased, e.g., above 88° F. This could be accomplished by fabricating intermediate portion 289 as a telescoping member containing a precompressed spring. The telescoping portion would initially extend to a length equal to that of intermediate portion 289 which would contact seat surface 284 at the same pressure (temperature) of the gas in the energy cell for the embodiment illustrated in FIG. 35 to define V-1. However, as the temperature of the gas in energy cell 11 increases and correspondingly the pressure, the intermediate portion would telescope to define a smaller V-1 volume thereby maintaining the mass or weight of $CO_2$ gas stored therein constant even though the pressure and temperature of the gas increased.

Figure 36:
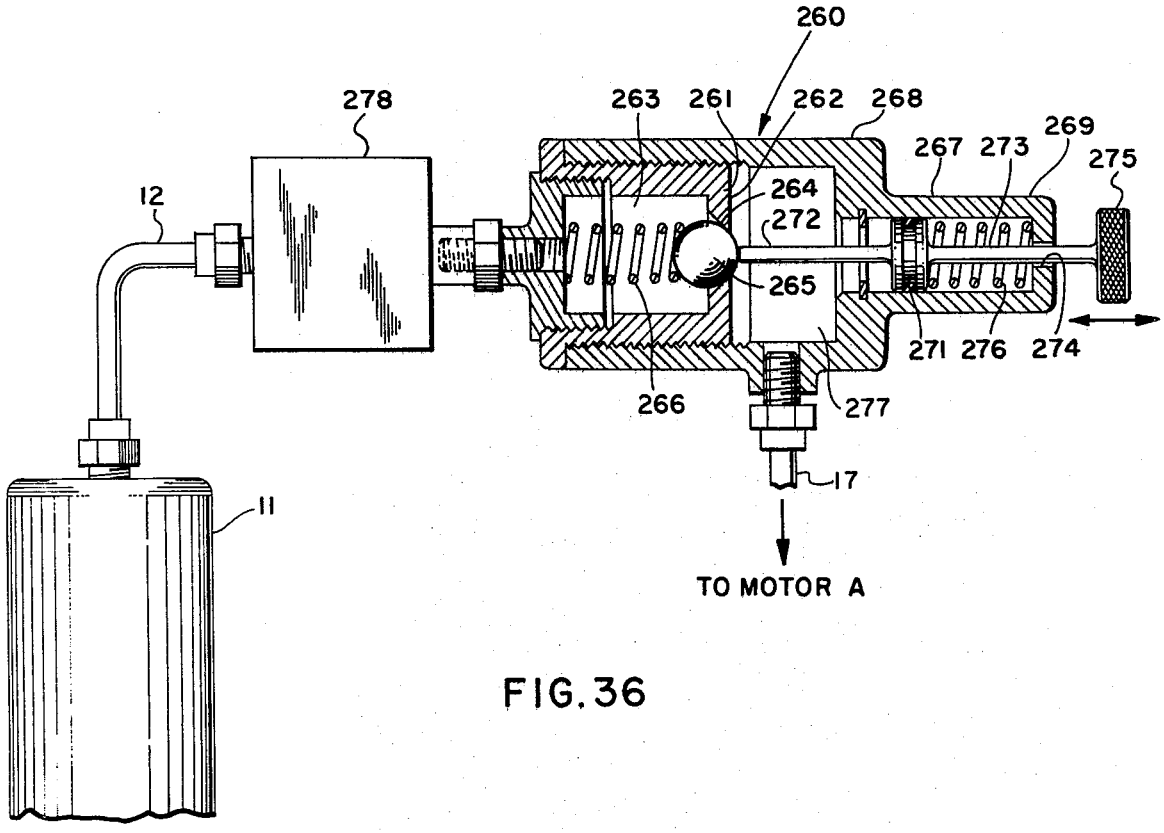
FIG. 36 is a diagrammatic view of a starting system similar to that of FIG. 17 illustrating a sectional view of a valve used in such system.

The metering valve means heretofore has been defined as including a plenum and valve unit 13. Shown in FIG. 36 is a hammer type timing valve 260 functioning as metering means in place of the plenum and valve unit. Hammer type timing valve 260 includes basically a spring biased ball check valve opened and closed at timed intervals by a spring biased plunger. The check valve includes an externally threaded cylindrical housing 261 having closed end face portion 262 defining a chamber 263 adapted to be in fluid communication with energy cell 11 through inlet conduit 12. A round opening in end face 262 functions as a ball valve seat 264 and a spherical ball member 265 is biased by a spring 266 in chamber 263 into sealing engagement with valve seat 264. A hollow cylindrically stepped plunger housing 267 having an internally threaded large diameter portion 268 and a smaller diameter portion 269 depending therefrom is screwed into gas-tight relationship with externally threaded cylindrical housing 261. Disposed in sealing sliding engagement within the bore of small diameter portion 269 is a plunger 271. On one side of plunger 271 is a valve rod extending into engagement with ball valve member 265. On the opposite side of plunger 271 is an actuating rod 273 extending through an opening 274 in the rear of small cylindrical diameter portion 269 to which a knob 275 is secured. A compression spring 276 between plunger 271 and the end of small cylindrical diameter portion 269 biases valve rod 272 into engagement with ball valve member 265 but the force of spring 276, in a static position, is not sufficient to overcome the force of spring 266, and gas pressure therein, to unseat ball valve member 265 from seat 264.

The interior of large cylindrical diameter portion 268, end face portion 262 and plunger 271 defines a valve chamber 277 in fluid communication with outlet conduit 17 leading to motor A. Check valve chamber 263 may be directly connected to cell 11 by conduit 12 but preferably, as shown in FIG. 35, is connected to a known pressure regulator 278 in turn connected to energy cell 11. Pressure regulator 278 maintains a constant pressure from cell 11 to check valve chamber 263 when timing valve 260 is operated thereby making the system "self-regulating". When it is desired to charge motor A with a predetermined amount of gas, the operator pulls knob 275 away from plunger housing 267 compressing spring 276 either solid or to a solid stop (not shown). When the operator releases knob 275, the force of spring 276 wit the mass of plunger 271, valve rod 272 and actuating rod 273 is sufficient to move ball valve member 265 off seat 264 for a predetermined time sufficient to enable the gas exiting cell 11 to pass through regulator 278, hammer valve 260 and conduit 17 to operate motor A. It should be noted that the gas will undergo an expansion in chamber 277 and conduit 17 and in this sense chamber 277 and conduit 17 may be viewed as a plenum chamber. The expansion of the gas in chamber 277 and conduit 17 causes the motor to continue to operate after the valve 260 has shut off flow of gas from the energy cell 11.

OPERATION

The operation of the starter system disclosed is best explained with reference to a walk-behind, power lawn mower (FIG. 35) and its operating environment, the mower utilizing a 4–4½ hp., four cycle internal combustion engine. Such lawn mower engine when furnished with conventional hand-pull or spring starting systems employs a known clutchflywheel arrangement which provides a 1.8 gear reduction to the engine from the speed of the hand-pull starter and a valve lift mechanism which prevents the valves in the engine from seating in a sealing manner during starting attempts in order to reduce compression and consequently operator effort. The starter system explained herein is applied to such an engine. Two cycle engines employed in lawn mowers use a similar arrangement. Two cycle engines used in power chain saw applications (FIG. 2) employ the known valve lift mechanism for ease of starting but the starter directly drives the engine, without any gear reduction, because of the relatively small sized engine used on powered chain saws. Nevertheless, it has been determined that the starting requirements in terms of chances to fire, starting speed, etc. closely parallel that of the four cycle engine described herein. For example, tests have indicated that an engine starting speed at 600 rpm is fairly reliable and that the starting speed range is defined herein for a four cycle engine is applicable to a two cycle engine. While theoretically the starter system can be applied to any size internal combustion engine, application of the system to relatively large engines may necessarily result in design changes to motor A and in the system disclosed herein. Accordingly, the motor and system disclosed herein are limited to relatively small two and four cycle engines of 10 hp. or less driving consumer operated implements in which field of use the motor and system application is unique. It should be noted that a motor of the design disclosed herein has successfully started a 10 hp. outboard motor.

Commercial success of the starter system disclosed dictates that the system must be designed to cost and operate economically with good starter reliability characteristics. It has been determined, after investigating starter characteristics of small horsepower engines, that the starter must rotate the engine's piston at a predetermined force and speed through its first compression stroke at the end of which firing or ignition occurs, hereinafter referred to as a compression-ignition stroke. If ignition does not occur at the first compression-ignition stroke, rotating the engine through its second compression-ignition stroke at generally the same speed insures a fairly high firing rate. If the engine hasn't fired by the completion of the third compression-ignition stroke, even at reduced engine speed, starter reliability is not significantly enhanced by carrying the engine through its fourth, fifth, etc. cycles.

Tests on existing starter systems show that the conventional ropepull starters when given a "hard" pull develop an excellent engine speed through the first, second and third compression-ignition strokes to insure firing of the engine. However, if the operator of the lawn mower is physically unable to exert "hard" tugs on the starter, a "light" pull on the starter rope shows a marked decrease in engine cranking speed, which while maintained through two successive compression-ignition strokes of the engine, does not possess the starting reliability associated with a "hard" pull. Spring start systems, on the other hand, do not appear to afford the reliability of a rope-pull starter system. The release of a compressed starter spring is best likened to an instantaneous impulse since the spring force rapidly diminishes once released. As noted above, physical force limitations imposed by the operator determine the precompression force of the spring. If the engine happens to rest on its power stroke when the spring is released and the engine must be cranked through successive power, exhaust and intake strokes before reaching a compression-ignition stroke, the reliability of the system in maintaining a suitable engine speed through the second compression-ignition stroke is believed to drop significantly. The gas powered motor and system disclosed, when properly designed as explained below, will operate, in a gas conserving manner, to develop high torque and speed characteristics sufficient to crank the engine through its first compression-ignition stroke at a speed approximately equal to that developed by the "hard" pull rope starter. The engine cranking speed will be maintained somewhat constant, as in the hard pull rope starter system, through the second compression-ignition stroke with sufficient system inertia to carry the motor through a third compression-ignition stroke. The motor, when operated in such a manner, insures excellent starter reliability.

To achieve this characteristic in a gas powered motor, a multicylinder motor is required. While a single, reciprocating cylinder could be applied in a motor, the torque requirement characteristics of the system would still require a similar volume displacement to that of the radial motor disclosed. Since the engine may have to be started on a compression-ignition stroke, a long slider crank mechanism would have to be employed, thus rendering the single cylinder motor design impractical for application to consumer operated implements. For the same reason, a multiple, in-line cylinder arrangement is not practical, both from a mounting and cost consideration basis. Limiting the consideration to radial type motors when used as gas expanders, the present state of the art discloses serious sealing problems (among other things) afflicting vane type and gear type motors which are overcome in radial piston motor A by the use of the piston sealing lip configuration 75 and the properties of commutator valve 31. Limiting design considerations to radial type piston engines, torque requirements of the motor as defined above, especially considering the probability of starting an engine at rest in its compression-ignition stoke and the requirements of having, as nearly as possible, a constant torque and output curve, limits the minimum number of cylinders in such radial piston engine to eight. Practical space limitations set the upper limit of cylinders at 12. Within these limits, satisfactory torque-speed requirements can be obtained with cylinders between ½ and 1 inch in diameter with pistons thereon having a stroke between ½ and 1 inch. In the motor designated as the A embodiment, the cylinders number 12, with a diameter of approximately ½ inch and piston stroke of ½ inch. In the motor designated as the A' embodiment, the cylinders number 10 with a diameter of approximately ½ inch and a piston stroke of approximately ½ inch.

With the establishment of the basic parameters of the motor design, the valving of the gas through the motor to the cylinder becomes critical from both power and gas conservation considerations. A satisfactory fuel efficiency with suitable torque requirements is obtained if the valving is sized or timed to span at least 1½ cylinders at any given time but not more than 2½ cylinders. In the motor shown in embodiment A', the valving is established at a length extending 1.77 cylinders. Further entering into consideration of valve timing is the fact that the valving disclosed, while providing a restriction of gas flow therethrough, is also believed to act as a throttling mechanism in the sense that even though a somewhat detrimental expansion occurs in radial inlet passages 204, the flow through the valving and the passages establishes discrete time during which the motor is powered to thereby develop a torque curve of sufficient duration. The discrete time is of course varied by the pressure level of the gas charging the motor. Further entering into the valving consideration is the fact that the known clutch "C" employs the convention "Bendix" drive principle wherein motor A or A' turns a shaft carrying a driving gear in some form of threaded engagement therewith. The driving gear advances on the shaft a fixed distance until engaging the driven gear. It is significant that while the driving gear is advancing on the shaft, motor A or A' is not under load. Therefore, motor A or A' can be brought up to its operating speed quickly and is thus able to develop the torque requirements, as explained hereafter, when the driving gear meshes with the driven gear.

With the motor design thus established, the motor performance, its torque, speed and operating characteristics are directly affected by the pressure and expansion characteristics of the gas. While in theory any pressurized gas can operate the motor, the system, as applied to lawn mowers which generally do not operate in temperatures less than 50° F, is commercially limited to the use of liquified $CO_2$ gas stored in an energy cell. Chain saw applications, on the other hand, are exposed to greater temperature variations than lawn mower applications and will operate at temperatures which will liquify $CO_2$ thus resulting in the use of other gases or gases mixed with $CO_2$. As used herein, "liquified" gas or "liquifiable" gas means any such gas or gas mixture.

Carbon dioxide is noncombustible, economically manufactured and possesses a critical temperature of 84°-88° F (dependent on water density) which permits the gas to be bottled in a saturated vapor state. The latter point is critical since the existence of a gas-liquid phase permits the energy cell, at a constant temperature, to deliver gas at a constant pressure. However, the pressure of the $CO_2$ gas directly corresponds to the temperature and the greater the temperature, the greater the pressure and the greater the amount of gas used, for a given, constant volume, in starting the motor. Furthermore, the motor speed is directly dependent on gas pressure.

Clearly, if a simple toggle switch were used to control the flow of gas from the cell to the motor, the consumption of the gas used in starting the motor would be excessive. That is, the size of the energy cell, its weight and its cost which necessarily will result from the use of the toggle switch would prohibit the system application to the lawn mower and chain saw field of use. Accordingly, a metering system which charges an amount of gas to the motor, just sufficient to insure starting while conserving gas utilized from the energy cell is essential for a viable system.

In the embodiments illustrated in FIGS. 19, 20, 34 and 35, the metering system takes the form of a valve unit 13 in combination with a plenum chamber. First, all the plenum chambers disclosed are manufactured from relatively thick walled steel and function as heat sinks in the sense that the gas flowing from the energy cell is assured of a contact with a sufficient mass to permit suitable expansion of the gas therein to develop sufficient pressure, when the plenum is opened to the motor, to drive the motor at a sufficient force and speed to start the engine. Second, to insure that the plenum is always at a temperature at least equal to the energy cell temperature and preferably greater, as shown in FIG. 37, the plenum is mounted closely adjacent the engine so as to be heated by the heat therefrom. The energy cell on the other hand is mounted at a point spaced away from the engine so as not to be affected by the heat therefrom and is also mounted with its outlet pointed upward to avoid discharging the liquid instead of gas therefrom. Furthermore, the outlet of the plenum is mounted closely adjacent the motor so as not to be affected by undue pressure losses therein. By thus insuring that the plenum is at a temperature equal to or greater than that of the energy cell, liquification of the gas resulting in a significant amount of gas to charge the plenum is minimized. This might occur if the plenum cooled under repeated expansion from the gas, of if the gas entering the plenum is at a higher temperature than the plenum. The fuel savings are significantly increased when it is realized that most of the starting attempts to which the engine is subjected to when operated by the consumer are conducted when the engine is in a heated state. Third, the plenums disclosed herein take into account variations in pressures of the gas leaving the energy cell 11 to conserve gas while insuring adequate motor output. That is, the variable volume plenum illustrated in FIG. 19 may be manually adjusted to a smaller volume when the engine is hot and/or outside temperature is high. The catalytic plenum shown in FIG. 20 is of a smaller volume than that normally needed to start the engine with the heat from the catalyst being such as to raise the temperature and pressure of the gas. The constant pressure plenum shown in FIG. 34, when operated at high temperatures (greater than 84° F), automatically reaches a shutoff pressure faster and thus requires less mass of gas otherwise required to charge a given volume. The automatic variable volume plenum shown in FIG. 35 automatically changes its volume as a function of gas temperature and pressure. It is important that the plenums illustrated in FIGS. 34 and 35 are automatic or self-regulating in their response to changing conditions in the operating environment. That is, the automatic variable volume plenum of FIG. 35 and the constant pressure plenum of FIG. 34 (and also the metering system of FIG. 36) insure that between the limits of uppermost and lowermost ambient operating temperatures (50° F to 100+° F), the amount of gas used to fill the plenum and thus charge the motor will fall within a range which will represent a reasonable gas conservation range. It should be noted that while, theoretically, the constant pressure plenum will always fill to a constant mass of $CO_2$, observations from test indicate that a variation in mass with the gas at different temperatures does occur for a number of reasons and such variation represents the range referred to above. The range with respect to the automatic variable volume plenum is, of course, established by the volumes V-1 V-2 L heretofore defined.

In the metering arrangement shown in FIG. 36, the time delay switch would be positioned adjacent the energy cell and the tubing from the switch to the motor which would be positioned around the engine would have a sufficient mass and conduction characteristic to similarly function as an adequate heat sink, thereby permitting the gas to expand without undue pressure loss.

Figure 38:
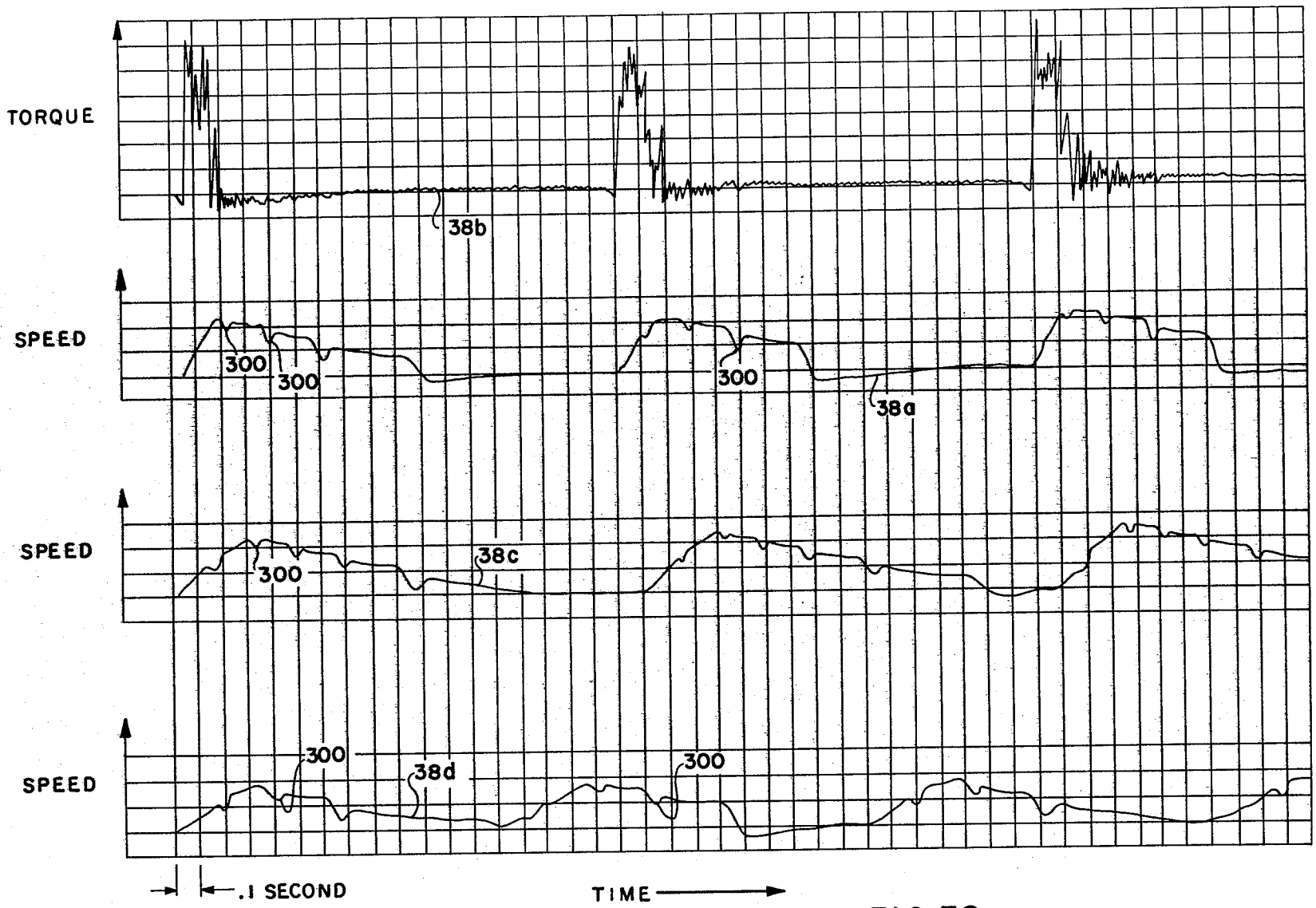
FIG. 38 comprises graphs or traces of motor starter systems when operated.

Having thus explained the system characteristics and interrelationships between parts thereof, reference may be had to the graphs shown in FIG. 38. The graph designated 38*a* is a speed (X-axis) - time (Y axis) trace of the speed of an engine when coupled to motor A'. The engine sparkwire was removed to prevent firing and the test were conducted with energy cell 11 placed in ambient temperatures ranging into the seventies (degrees Fahrenheit). The plenum employed utilized an average of approximately 3 grams per start. The graph divisions shown for all graphs are in tenths of a second and each dip 300 shown in all speed-time traces is the point where the piston in the engine reached top dead center on its compression-ignition stroke. Analysis of graph 38*a* shows that each charge of gas from the plenum was sufficient to enable the motor to have three chances to fire with the first and second chances of firing occurring at speeds approximately equal to one another even though top dead center of the compression-ignition stroke occurred at various time in the starting cycles. Graph 38*b* shows a torque (Y axis) - time (X axis) trace which the motor developed for each speed-time trace shown in graph 38*a;* each torque-time trace corresponding to the speed-time trace positioned directly therebelow as shown in FIG. 38. It should be noted that the rapid peaks and valleys exhibited in the torque force correlate to the force impulses generated in the cylinders of the motor. Therefore, as the number of cylinders increase, as explained above, the torque curve will more gradually approach a horizontal line. Importantly, the torque developed is shown to exist as a "timed" impulse for a time increment sufficient to allow the motor to crank the engine's piston through top dead center of its compression-ignition stroke, thereby imparting a sufficient inertia force to the moving parts of the engine to rotate same through the next two successive compression-ignition strokes. The duration of the timed increment is believed dependent on the amount of gas in the plenum and the valving as explained above. For comparison purposes, graph 38*c* shows a speed-time trace for a rope pull starter when same is pulled with a "hard" tug and graph 38*d* shows a same speed-time trace of a rope pull starter system when pulled with a "light" tug. The scales for graphs 38*a, c* and *d* are identical.

Experiments with various types of plenum capacities, gas pressures, etc. indicate that the torque-time characteristics of the motor as explained above will generate a satisfactory, reliable, gas conserving starting system if the crank speed of the engine through its first compression-ignition stroke is at least 650–700 rpm. That is, while it has been possible to start a "new" engine somewhat consistently at speeds as low as 450 rpm, consideration must be given to the fact that as the engines age, engine points close, spark intensity weakens and the carburetion system tends to become dirty and clogged. Accordingly, a higher "minimum" starting speed (650–700 rpm) is required to offset such factors to insure starter reliability. Furthermore, it has also been determined that the first compression-ignition stroke must occur at this starting speed while the torque is still being developed in the motor, the torque being of such a value as to carry the engine through at least a second compression-ignition stroke without substantial decrease in speed occurring in the second successive compression-ignition stroke and then through a third compression-ignition stroke. Various plenum designs capable of using between an average 2–4 grams of $CO_2$ per start in the motor design disclosed are capable of meeting these requirements.

The invention has been described with reference to a preferred embodiment. Obviously alterations and modifications will occur to others upon reading and understanding the specification. It is my intention to include all such alterations and modifications insofar as they come within the scope of the present invention.

If is thus an essential feature of my invention to provide a gas powered start system for relatively small internal combustion engines which is characterized by its gas conserving capabilities and an economical motor of simple design.

Having thus defined the invention, I claim:

1. A gas powered starting system for two and four cycle internal combustion engines preferably of a size that delivers less than 10 horsepower and possesses in its cycle a compression stroke at the end of which said engine is fired, said system comprising:

an energy cell containing liquified gas under pressure;

a motor having an output shaft;

clutch means engaging said output shaft to permit said motor to drive said engine through its cycles for starting same; and self-regulating metering valve means in fluid communication with said energy cell and said motor, said self-regulating valve means comprising a valve for controlling the flow of gas from said energy cell, a fluid passage between said energy cell and said valve and a fluid passage between said valve and said motor, said valve being operable to cut off flow of gas from said energy cell through said valve while permitting gas in said fluid passage between said valve and said motor to expand and flow to and operate said motor after said valve has cut off the flow of gas from said energy cell, whereby said valve means is operable to automatically meter an amount of gas within a predetermined range from said energy cell to said motor sufficient to enable said motor to start said engine.

2. The starting system of claim 1 wherein said metering valve means is operable to meter a fixed amount of gas at a pressure sufficient to cause said motor to rotate said engine through at least three compression strokes with the first compression stroke occurring at an engine speed of approximately 650–700 rpm.

3. The system of claim 2 wherein said metering valve means is operable to deliver a metered amount of gas to said motor to enable said motor to develop torque for a time period sufficient to drive said engine through at least its first compression stroke whereby the inertia of the engine is sufficient to drive said engine through at least two successive compression strokes.

4. The system of claim 3 wherein said metering valve means further includes:

a plenum containing an enclosure having a chamber therein, piston means movable in said chamber to define a plenum chamber, and means automatically controlling movement of said piston means in response to the pressure of said gas to meter a predetermined amount of gas by weight to said plenum chamber;

valve means operable to first place said plenum chamber in fluid communication with said energy cell and out of communication with said motor whereby said plenum chamber is filled with said predetermined amount of gas and then to place said plenum chamber in fluid communication with said motor while preventing fluid communication between said plenum chamber and said energy cell whereby the gas in said plenum is supplied to said motor which then drives said engine.

5. The system of claim 4 wherein said liquified gas is $CO_2$, said plenum is spaced closely adjacent said motor and said engine and said energy cell is spaced away from said engine in an upright position.

6. The system of claim 5 wherein said motor comprises a plurality of cylinders disposed generally radially about an axis, a piston disposed in each cylinder and adapted to rotate said output shaft upon movement in said cylinder, commutator valving means for sequentially charging said cylinders, said cylinders comprising no less than eight in number and said commutator valving means sized to insure that at least 1.5 but not more than 2.5 cylinders are in fluid communication with said metering valving means.

7. Apparatus comprising a motor having a rotatable member, adapted to be driven by pressurized gas supplied to said motor, a source of pressurized gas, a self-regulating plenum chamber for temporarily storing an amount of gas determined by its weight within a predetermined range even though the pressure of said gas exceeds a predetermined minimum pressure, and means to put said plenum chamber in communication with said source of pressurized gas to charge said plenum chamber with a predetermined amount of gas, and then to put said plenum chamber in communication with said motor to drive said motor by said predetermined amount of gas in said plenum chamber while preventing flow of gas from said source of pressurized gas to said motor and said plenum chamber.

8. The apparatus of claim 7 in which said motor comprises a plurality of cylinders radially arranged around a crankshaft and adapted to provide relative rotation between said crankshaft and said cylinders when said motor is supplied by said pressurized gas.

9. The apparatus of claim 7 comprising valve means adapted first to put said source of pressurized gas in communication with said plenum chamber to charge it with a predetermined amount of gas, then to shut off said plenum chamber from said source of gas, then to put said plenum chamber in communication with said motor to supply pressurized gas from said plenum chamber to said motor.

10. The apparatus of claim 7 comprising means for varying the volume of said plenum chamber in a ratio generally inversely proportional to the pressure of said gas in said source.

11. The apparatus of claim 7 comprising means for heating the gas while it is in said plenum chamber.

12. The apparatus of claim 11 in which said means for heating said gas while it is in said plenum chamber comprises catalytic material in contact with said plenum chamber, and means for contacting said catalytic material with fuel which when contacting said catalytic material will undergo combustion to heat said plenum chamber.

13. The apparatus of claim 7, in combination with an internal combustion engine of a powered implement having a rotatable shaft by which said engine is started, and clutch means connected to said rotatable member of said motor and said rotatable shaft of said engine.

14. A gas powered starting system for two and four cycle internal combustion engines preferably of a size that delivers less than 10 horsepower and possesses in its cycle a compression stroke at the end of which said engine is fired, said system comprising:

an energy cell containing liquified $CO_2$ gas;

a motor having an output shaft;

clutch means engaging said output shaft to permit said motor to drive said engine through its cycles for starting same; and metering valve means in fluid communication with said energy cell and said motor, said metering valve means comprising a valve for controlling the flow of gas from said energy cell, a fluid passage between said energy cell and said valve and a fluid passage between said valve and said motor, said valve being operable to cut off flow of gas from said energy cell through said valve while permitting gas in said fluid passage between said valve and said motor to expand and flow to and operate said motor after said valve has cut off the flow of gas from said energy cell whereby said valve means is operable to meter a fixed amount of gas at pressure sufficient to cause said motor to rotate said engine through at least three compression strokes with the first compression stroke occurring at an engine speed of approximately 650–700 rpm.

15. The system of claim 14 wherein said metering valve means is operable to deliver a metered amount of gas to said motor to enable said motor to develop torque for a timed impulse period sufficient to drive said engine through at least its first compression stroke whereby the inertia of the engine is sufficient to drive said engine through two successive compression strokes.

16. The system of claim 15 wherein said metering valve means is operable to deliver a torque of sufficient force and duration to cause the speed for the first two compression strokes of the engine to be relatively constant.

17. The system of claim 16 wherein said metering valve means is further operable to automatically regulate, in a gas conserving manner, the amount of gas metered to said motor in accordance with the pressure of said gas in said energy cell once said pressure exceeds a predetermined minimum valve.

* * * * *

UNITED STATES PATENT AND TRADEMARK OFFICE

CERTIFICATE OF CORRECTION

PATENT NO. : 4,085,589

DATED : April 25, 1978

INVENTOR(S) : John H. Breisch

It is certified that error appears in the above-identified patent and that said Letters Patent are hereby corrected as shown below:

| | | |
|---|---|---|
| Column 10, | line 8, | after "permit" insert --this action to occur.-- and delete "be identical in size and shape. As" |
| | line 9, | delete lines 9 to 35, inclusive. |
| Column 11, | line 49, | change "121" to --212. |
| Column 12, | line 63, | change "223" to --233--. |
| Column 16, | line 22, | change "seal" to --sealed--. |
| Column 18, | line 41, | after "rod" insert --272--; |
| | line 68, | change "wit" to --with--. |
| Column 19, | line 39, | change "is" to --as--. |
| Column 21, | line 21, | after "establishes" insert --a--. |
| Column 23, | line 5, | after "V-2" delete "L". |
| Column 24, | line 22, | change "If" to --It--. |

Signed and Sealed this

*Fifth* Day of *September 1978*

[SEAL]

*Attest:*

RUTH C. MASON
*Attesting Officer*

DONALD W. BANNER
*Commissioner of Patents and Trademarks*